US011656052B2

(12) United States Patent
Kimmel et al.

(10) Patent No.: US 11,656,052 B2
(45) Date of Patent: May 23, 2023

(54) SUPPORT MOUNT FOR TRIPOD OR THE LIKE

(71) Applicant: Mazatzal Outdoor Solutions LLC, Phoenix, AZ (US)

(72) Inventors: Colton Davis Kimmel, Phoenix, AZ (US); Cody Chase Kimmel, West Linn, OR (US); Erik Matthew Henrikson, Phoenix, AZ (US); Tom Granberg, Phoenix, AZ (US)

(73) Assignee: MAZATZAL OUTDOOR SOLUTIONS LLC, Phoenix, AZ (US)

( * ) Notice: Subject to any disclaimer, the term of this patent is extended or adjusted under 35 U.S.C. 154(b) by 0 days.

(21) Appl. No.: 17/512,349

(22) Filed: Oct. 27, 2021

(65) Prior Publication Data

US 2022/0128326 A1 Apr. 28, 2022

Related U.S. Application Data

(60) Provisional application No. 63/106,095, filed on Oct. 27, 2020.

(51) Int. Cl.
*F41A 23/14* (2006.01)

(52) U.S. Cl.
CPC ..... *F41A 23/14* (2013.01)

(58) Field of Classification Search
CPC ..... F41A 23/12; F41A 23/14
USPC ..... 42/94; 89/40.06
See application file for complete search history.

(56) References Cited

U.S. PATENT DOCUMENTS

| | | | | |
|---|---|---|---|---|
| 6,058,641 | A | 5/2000 | Vecqueray | |
| 6,773,172 | B1 | 8/2004 | Johnson et al. | |
| D521,100 | S | 5/2006 | Morrow | |
| 7,077,582 | B2 | 7/2006 | Johnson | |
| D553,219 | S | 10/2007 | Potterfield | |
| 7,356,960 | B1 * | 4/2008 | Knitt | F41A 23/16 89/37.04 |
| D576,245 | S | 9/2008 | Potterfield et al. | |
| 7,584,690 | B2 | 9/2009 | Cauley | |
| 7,774,972 | B2 | 8/2010 | Potterfield et al. | |
| D626,620 | S | 11/2010 | Hicks | |
| D627,033 | S | 11/2010 | Hicks | |

(Continued)

OTHER PUBLICATIONS

Triclawps, "Triclawps Solo," <https://triclawps.com/collections/all/products/triclawps-solo-saddle> web page visited Nov. 16, 2021.

(Continued)

*Primary Examiner* — Bret Hayes
(74) *Attorney, Agent, or Firm* — Michael Best & Friedrich LLP

(57) ABSTRACT

A support mount is configured to couple a firearm to a support stand. The support mount includes an attachment member configured to be selectively coupled to the support stand, a first platform coupled relative to the attachment member in a first orientation relative to the attachment member, and a second platform coupled relative to the attachment member in a second orientation. The second orientation is oriented differently than the first orientation of the first platform. The support mount includes an adjustment subassembly operable to move the first platform and the second platform relative to each other. The adjustment subassembly is configured to clamp the firearm to the support mount.

18 Claims, 18 Drawing Sheets

(56) References Cited

U.S. PATENT DOCUMENTS

| | | | | |
|---|---|---|---|---|
| 7,823,317 | B2 | 11/2010 | Potterfield et al. | |
| D631,525 | S | 1/2011 | Smith et al. | |
| 7,946,071 | B2 | 5/2011 | Cauley | |
| 7,980,017 | B2 | 7/2011 | Harman, III | |
| 7,997,021 | B2 | 8/2011 | Cauley et al. | |
| 8,011,129 | B2 | 9/2011 | Cauley et al. | |
| 8,083,198 | B2 | 12/2011 | Stabler | |
| 8,132,351 | B2 | 3/2012 | Potterfield et al. | |
| 8,251,330 | B2 | 8/2012 | Stabler | |
| 8,296,988 | B2 | 10/2012 | Yale et al. | |
| 8,356,442 | B2 | 1/2013 | Potterfield et al. | |
| 8,393,106 | B2 | 3/2013 | Cauley et al. | |
| D683,778 | S | 6/2013 | Hicks | |
| 8,578,645 | B2 | 11/2013 | Cauley | |
| 8,621,773 | B2 | 1/2014 | Morrow et al. | |
| D698,888 | S | 2/2014 | Hicks | |
| 8,745,913 | B2 | 6/2014 | Hicks | |
| 8,931,201 | B2 | 1/2015 | Gianladis et al. | |
| 9,151,561 | B2 | 10/2015 | Morrow et al. | |
| 9,206,941 | B2 | 12/2015 | Smith et al. | |
| 9,702,653 | B2 | 7/2017 | Cauley, Jr. et al. | |
| 10,317,162 | B2 | 6/2019 | Morrow et al. | |
| 10,514,225 | B2 | 12/2019 | Cauley, Jr. et al. | |
| 10,571,211 | B2 | 2/2020 | Johnson, Sr. et al. | |
| 10,578,389 | B2 | 3/2020 | Kinney et al. | |
| 10,612,718 | B2 | 4/2020 | Johnson, Sr. et al. | |
| 10,782,085 | B2 | 9/2020 | Cauley, Jr. et al. | |
| 2007/0256346 | A1 | 11/2007 | Potterfield et al. | |
| 2008/0034636 | A1 | 2/2008 | Potterfield et al. | |
| 2008/0047189 | A1* | 2/2008 | Potterfield | F41A 23/16 42/94 |
| 2008/0263928 | A1 | 10/2008 | Potterfield | |
| 2008/0295379 | A1 | 12/2008 | Potterfield et al. | |
| 2009/0000175 | A1 | 1/2009 | Potterfield et al. | |
| 2009/0064559 | A1 | 3/2009 | Potterfield et al. | |
| 2010/0102178 | A1* | 4/2010 | Smith | F16M 13/00 248/122.1 |
| 2010/0126055 | A1 | 5/2010 | Potterfield | |
| 2010/0301184 | A1* | 12/2010 | Stabler | F41A 23/16 396/419 |
| 2011/0036236 | A1 | 2/2011 | Potterfield et al. | |
| 2011/0192069 | A1 | 8/2011 | Potterfield et al. | |
| 2011/0214330 | A1 | 9/2011 | Potterfield et al. | |
| 2012/0011759 | A1 | 1/2012 | Cauley et al. | |
| 2012/0085012 | A1 | 4/2012 | Potterfield et al. | |
| 2012/0102806 | A1 | 5/2012 | Potterfield et al. | |
| 2012/0294672 | A1 | 11/2012 | Hicks | |
| 2013/0061564 | A1 | 3/2013 | Yale et al. | |
| 2013/0181024 | A1 | 7/2013 | Warner | |
| 2013/0256475 | A1 | 10/2013 | Warner | |
| 2014/0182183 | A1 | 7/2014 | Cauley et al. | |
| 2015/0354913 | A1 | 12/2015 | Morrow et al. | |
| 2019/0331459 | A1 | 10/2019 | Johnson, Sr. et al. | |
| 2019/0331460 | A1 | 10/2019 | Johnson, Sr. et al. | |
| 2020/0033089 | A1 | 1/2020 | Morrow et al. | |
| 2020/0158459 | A1 | 5/2020 | Johnson, Sr. et al. | |
| 2020/0182397 | A1 | 6/2020 | Johnson, Sr. et al. | |
| 2020/0240739 | A1 | 7/2020 | Cauley, Jr. et al. | |

OTHER PUBLICATIONS

Triclawps, "Triclawps Double Cam (MOD 2)," <https://triclawps.com/collections/all/products/triclawps-double-cam-mod-2> web page visited Nov. 16, 2021.

BOG, "Deathgrip Ultralite," <https://www.boghunt.com/pods/deathgrip-ultralite/1117132.html#start=1> web page visited Nov. 16, 2021.

Precision Hunting, "Rifle Saddle Mount Rifle Clamp Tripod Mount Adapter Precise Tripod Shooting Rest," <https://www.amazon.com/Saddle-Tripod-Adapter-Precise-Shooting/dp/B07Q455Q8P> web page visited Nov. 16, 2021.

Hog Saddle, "The Original Tripod Saddle," <https://hogsaddle.com/> web page visited Nov. 16, 2021.

Triclawps, "The Original Tripod Shooting Saddle," <https://triclawps.com/> web page visited Nov. 16, 2021.

Locked On 360, "Mobile Gun Vice," <http://mobilegunvise.com/> web page visited Nov. 16, 2021.

Battle Steel, "Battle Steel Gun Saddle Shooting Platform Polymer Made in USA, Black," <https://www.amazon.com/Battle-Saddle-Shooting-Platform-Polymer/dp/B07CLK4GRG> web page visited Nov. 16, 2021.

BOG, "BOG Deathgrip Shooting Tripod," <https://www.cabelas.com/shop/en/bog-deathgrip-shooting-tripod> web page visited Nov. 16, 2021.

Field Optics Research, "GunPOD FM-570B—Gen 4," <https://www.fieldopticsresearch.com/shop/c/p/GunPOD-FM-550B---Black-x32556480.htm> web page visited Nov. 16, 2021.

Accurate Shooter, "Ultimate Optics: BigEyes™ System from SWFA," <http://bulletin.accurateshooter.com/2009/03/ultimate-optics-bigeyes%e2%84%a2-system-from-swfa/> article dated Mar. 3, 2009.

Field Optics Research, "ASFP Arca Swiss F-Picatinny Lever Clamp with Pan Axis—NEW!!" <https://www.fieldopticsresearch.com/shop/Heads--QR-Plates/p/ASFPL-Arca-Swiss-F-Picatinny-Lever-Clamp-with-Pan-Axis---NEW-x51632630.htm> web page visited Nov. 16, 2021.

Really Right Stuff, "R Lock," <https://soar.reallyrightstuff.com/> web page visited Nov. 16, 2021.

* cited by examiner

SUPPORT MOUNT FOR TRIPOD OR THE LIKE

CROSS-REFERENCE TO RELATED APPLICATION

This application claims priority to U.S. Provisional Patent Application No. 63/106,095 filed Oct. 27, 2020, the entire contents of which are incorporated herein by reference.

FIELD OF THE DISCLOSURE

The present disclosure relates to a support mount selectively coupled to a tripod, bipod, etc., and more particularly to a support mount selectively coupled to a tripod, bipod, etc. to support at least one of a firearm or an accessory on the tripod, bipod, etc.

SUMMARY

In one aspect, a support mount is configured to couple a firearm and an accessory to a support stand. The support mount includes a base assembly including an attachment member configured to be selectively coupled to the support stand, a first base member coupled to the attachment member, a second base member coupled to the attachment member, and an adjustment subassembly coupled to the first base member and the second base member. The support mount includes a first platform moveably coupled to the first base member between a vertical orientation and a horizontal orientation relative to the first base member. The first platform is configured to support the accessory when the first platform is in the vertical orientation or the horizontal orientation. The support mount includes a second platform moveably coupled to the second base member between a vertical orientation and a horizontal orientation relative to the second base member. The second platform is configured to support the accessory when the second platform is in the vertical orientation or the horizontal orientation. The adjustment subassembly is operable to move the first platform and the second platform relative to each other. The adjustment subassembly is configured to clamp the firearm to the support mount.

In another aspect, a support mount is configured to couple a firearm to a support stand. The support mount includes an attachment member configured to be selectively coupled to the support stand, a first platform coupled relative to the attachment member in a first orientation relative to the attachment member, and a second platform coupled relative to the attachment member in a second orientation. The second orientation is oriented differently than the first orientation of the first platform. The support mount includes an adjustment subassembly operable to move the first platform and the second platform relative to each other. The adjustment subassembly is configured to clamp the firearm to the support mount.

In yet another aspect, a support mount is configured to couple an accessory to a support stand. The support mount includes an attachment member configured to be selectively coupled to the support stand, a first platform coupled relative to the attachment member in a first orientation relative to the attachment member, and a second platform coupled relative to the attachment member in a second orientation. The second orientation is oriented differently than the first orientation of the first platform. The second platform is configured to support the accessory when the second platform is in the second orientation. The support mount includes an adjustment subassembly operable to move the first platform and the second platform relative to each other.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and being practiced or being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
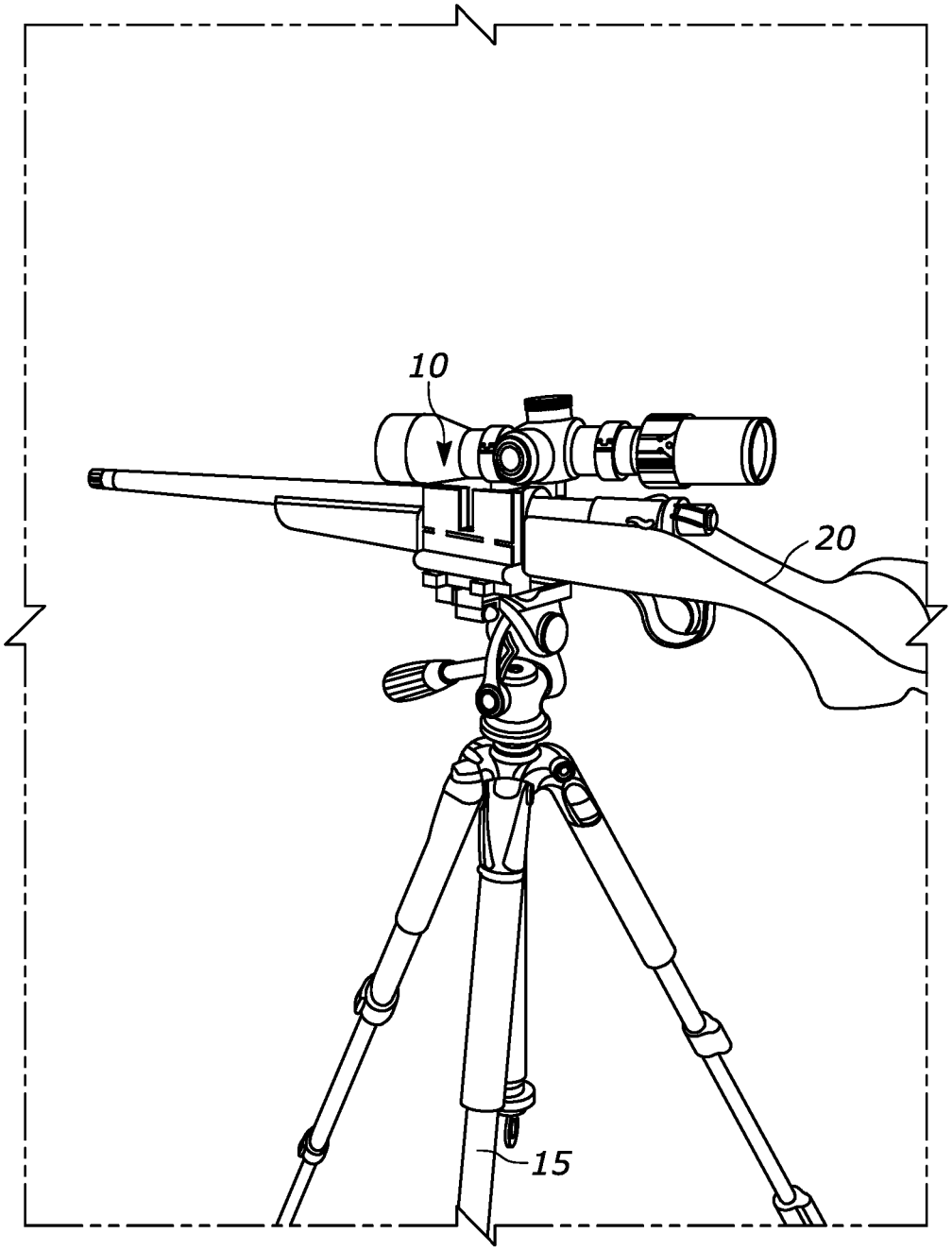
FIG. 1 is a perspective view of a support mount according to one embodiment coupled to a tripod and a firearm to support the firearm on the tripod.
Figure 2:
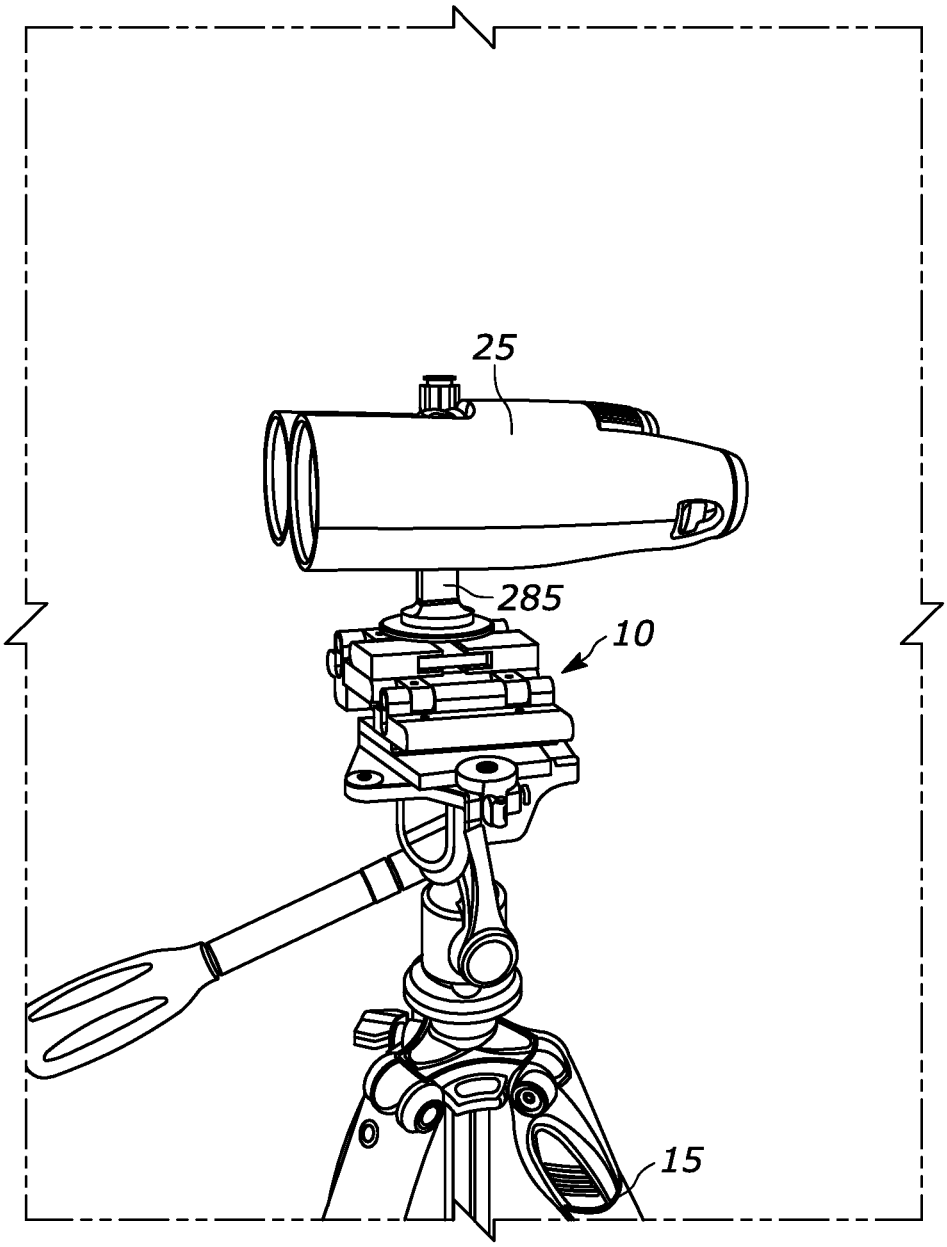
FIG. 2 is a perspective view of the support mount coupled to the tripod and an accessory, such as binoculars, to support the accessory on the tripod.

FIG. 1 illustrates a support mount 10 selectively coupled to a portable stand (e.g., a tripod 15). In other embodiments, the portable stand can be a bipod, monopod, etc. In further embodiments, the support mount 10 can be selectively coupled or fixedly coupled to a different type of stand (e.g., a non-portable stand). The illustrated support mount 10 can support a firearm 20 on the tripod 15 (FIG. 1) and can also be reconfigurable to support at least one accessory on the tripod 15. For example, as shown in FIG. 2, the support mount 10 can support an accessory 25 (e.g., optics including binoculars, spotting scope, range finder, etc.) on the tripod 15. In other embodiments, the accessory 25 can be a different accessory (e.g., a support to attach a camera, smartphone, etc. to the support mount 10).

With reference to FIGS. 3-6, the illustrated support mount 10 includes a base 30 having a body 35, a slider 40, and a fastener 45 defining a longitudinal axis 50. The fastener 45 is coupled to the body 35 and the slider 40. The illustrated body 35 includes a universal attachment member 60 and guide rails 70 extending in a direction parallel to the longitudinal axis 50. The universal attachment member 60 is of conventional design to couple to the tripod 15—includes ribs 75 formed on opposite edges of the universal attachment member 60 to be seated within an attachment feature of the tripod 15. The illustrated body 35 also includes a first base ring 80, a second base ring 85, a protrusion 90 positioned between the first and second base rings 80, 85, a first base cavity 100 positioned between the first base ring 80 and the protrusion 90, and a second base cavity 105 positioned between the second base ring 85 and the protrusion 90. The first base ring 80 defines a first base slot 110 in communication with the first base cavity 100, and the second base ring 85 defines a second base slot 115 in communication with the second base cavity 105. Both the first and second base rings 80, 85 are elongated in a direction transverse to the longitudinal axis 50 of the fastener 45 to form elongated first and second base slots 110, 115. A base stop surface 120 is formed on one side of the first and second base rings 80, 85, and a base support surface 125 is formed on the other side of the first and second base rings 80, 85. In the illustrated embodiment, the base support surface 125, the base stop surface 120, and a top surface of the guide rails 70 are positioned in the same horizontal plane. In other embodiments, the base stop surface 120 can be positioned in a plane spaced from the plane defining the base support surface 125. In further embodiments, the protrusion 90 can be omitted such that the base stop surface 120 forms a continuous surface with the base support surface 125. In addition, the base 30 also includes a threaded aperture 130 extending through the body 35 between the first and second base rings 80, 85. The threaded aperture 130 is sized to engage the fastener 45.

With continued reference to FIGS. 3-6, the illustrated slider 40 includes first and second channels 140 extending through the slider 40, a first slider ring 145, and a second slider ring 150. In addition, an intermediate ring 155 is positioned between the first and second slider rings 145, 150, a first slider cavity 160 is positioned between the first slider ring 145 and the intermediate ring 155, and a second slider cavity 165 is positioned between the second slider ring 150 and the intermediate ring 155. The first slider ring 145 defines a first slider slot 170 in communication with the first slider cavity 160, and the second slider ring 150 defines a second slider slot 175 in communication with the second slider cavity 165. Both the first and second slider rings 145, 150 are elongated in a direction transverse to the longitudinal axis 50 of the fastener 45 to form elongated first and second slider slots 170, 175. A slider stop surface 180 is formed on one side of the first and second slider rings 145, 150, and a slider support surface 185 is formed on the other side of the first and second slider rings 145, 150. In the illustrated embodiment, the slider stop surface 180 is positioned in a horizontal plane spaced from a horizontal plane defining the slider support surface 185, and the slider support surface 185 is positioned in the horizontal plane defining the base support surface 125. In other embodiments, the slider support surface 185 can be omitted. In addition, the slider 40 includes a lip 190 positioned on the side of the first and second slider rings 145, 150 opposite the slider stop surface 180, and the lip 190 is positioned in the same horizontal plane that defines the slider stop surface 180. In other embodiments, the intermediate ring 155 can be omitted such that the slider stop surface 180 forms a continuous surface with the lip 190. The slider 40 also includes a non-threaded aperture 195 extending through the slider 40 between the first and second channels 140. The non-threaded aperture 195 is sized to receive a portion of the fastener 45.

Figure 5:
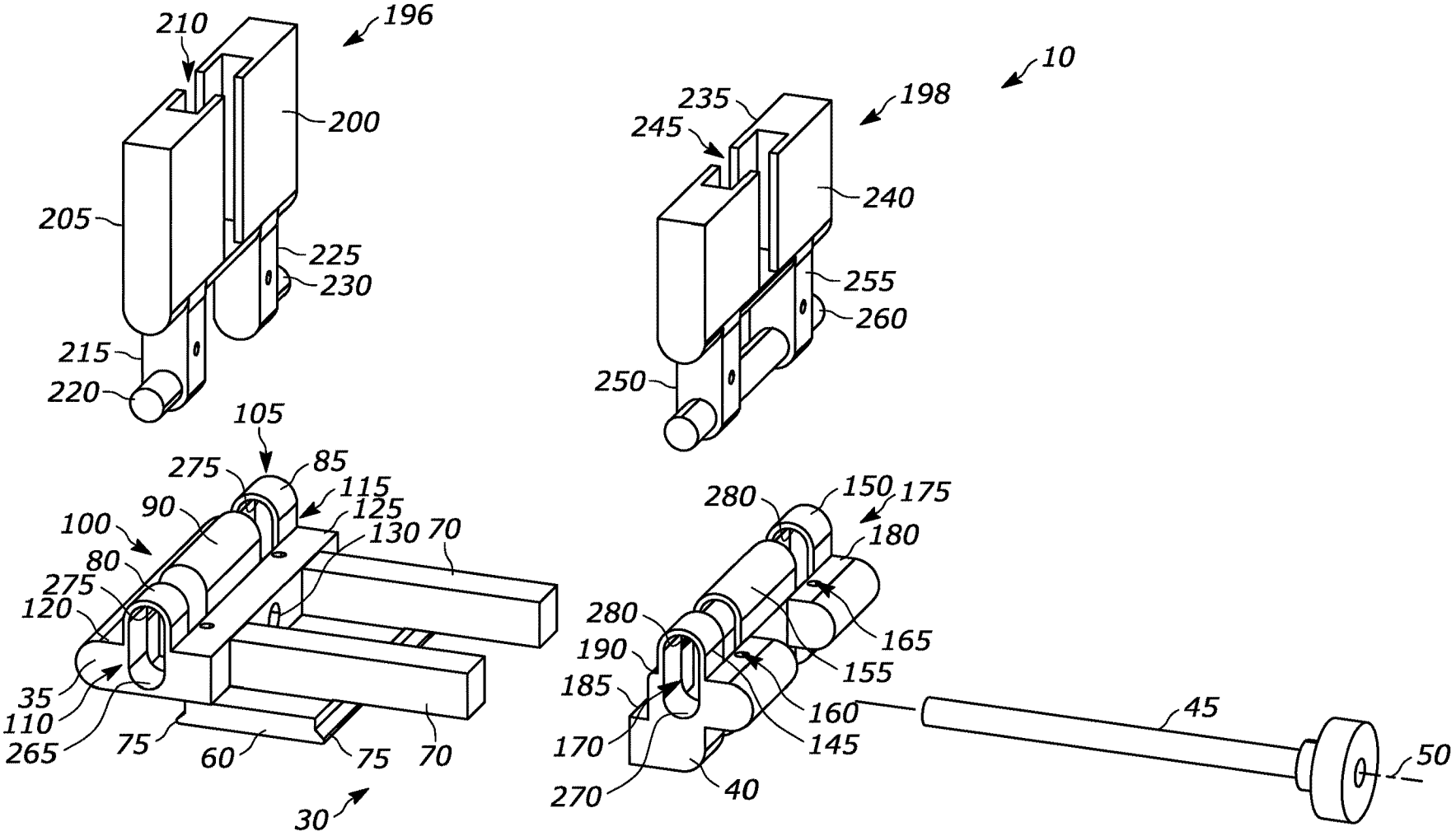
FIG. 5 is a first exploded view of the support mount of FIG. 3.
Figure 6:
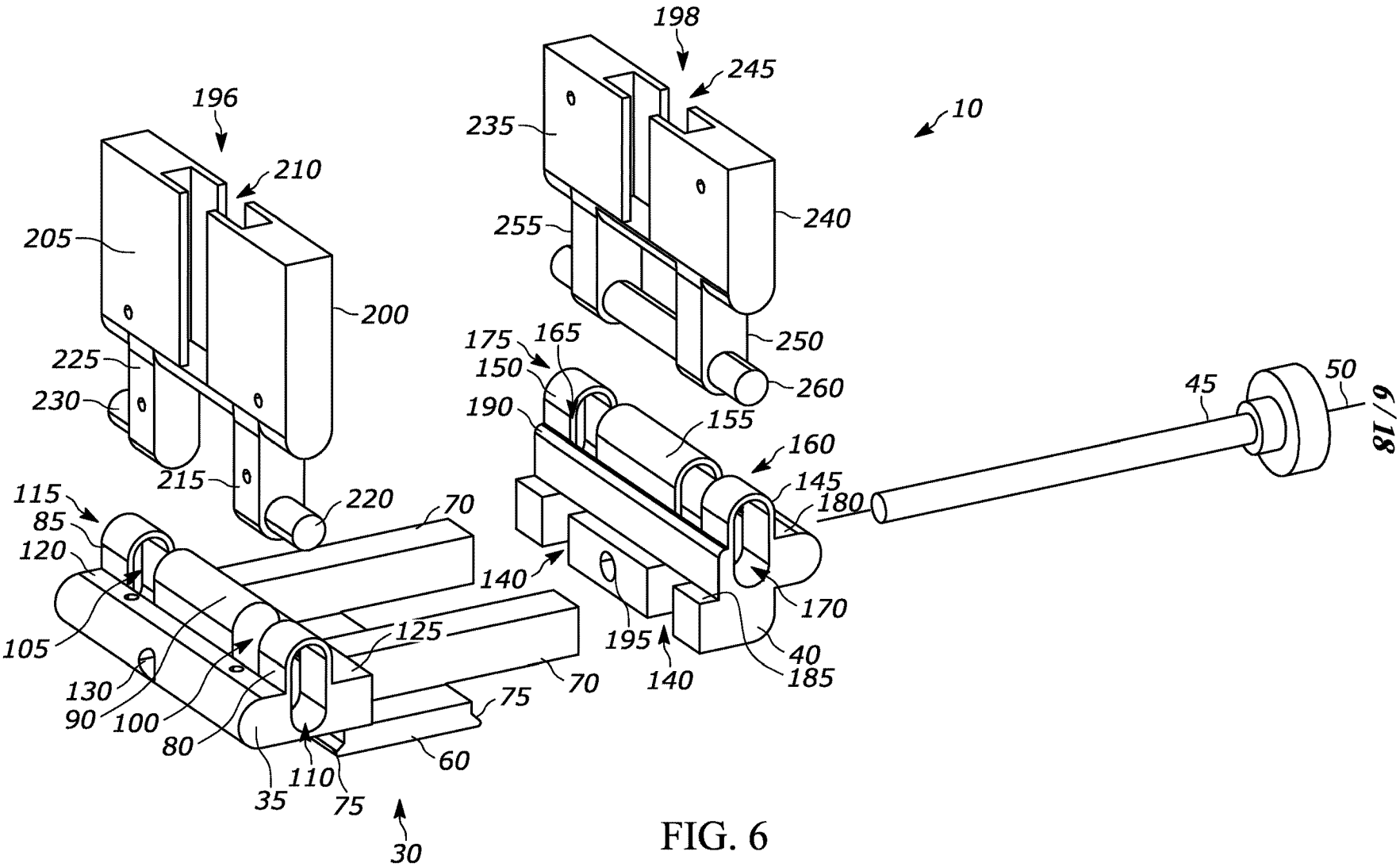
FIG. 6 is a second exploded view of the support mount of FIG. 3.

As best shown in FIGS. 5 and 6, the illustrated support mount 10 also includes a first wing support 196 (e.g., a first clamp member) coupled to the body 35 and a second wing support 198 (e.g., a second clamp member) coupled to the slider 40. The illustrated first wing support 196 includes a first surface 200 (e.g., a first clamping surface), a second surface 205 opposite the first surface 200, and a first support slot 210 (e.g., a first attachment feature) extending between the first and second surfaces 200, 205. The first wing support 196 also includes a first arm 215 having a first shaft 220 and a second arm 225 having a second shaft 230. Similarly, the illustrated second wing support 198 includes a first surface 235 (e.g., a second clamping surface), a second surface 240 opposite the first surface 235, and a second support slot 245 (e.g., a second attachment feature) extending between the first and second surfaces 235, 240. The second wing support 198 also includes a first arm 250, a second arm 255, and a shaft 260 extending between the first and second arms 250, 255.

During assembly of the support mount 10, the first and second channels 140 of the slider 40 receive the guide rails 70 of the body 35 to align the threaded aperture 130 with the non-threaded aperture 195. The fastener 45 extends through the non-threaded aperture 195 of the slider 40 to engage the threaded aperture 130 of the body 35. The first wing support 196 is coupled to the base 30 such that the first shaft 220 is received within the first base slot 110 and the second shaft 230 is received within the second base slot 115. As a result, the first arm 215 is received within the first base cavity 100 and the second arm 225 is received within the second base cavity 105. In other embodiments, the protrusion 90 of the body 35 can be hollow such that a single shaft of the first wing support 196 is received within the first base slot 110, the protrusion 90, and the second base slot 115. The second wing support 198 is coupled to the slider 40 such that the shaft 260 is received within the first slider slot 170, the second slider slot 175, and a slot defined by the intermediate ring 155. As a result, the first arm 250 is received within the first slider cavity 160 and the second arm 255 is received within the second slider cavity 165. In other embodiments, the intermediate ring 155 of the slider 40 can be solid such that a portion of the shaft 260 does not extend between the first and second arms 250, 255.

Figure 3:
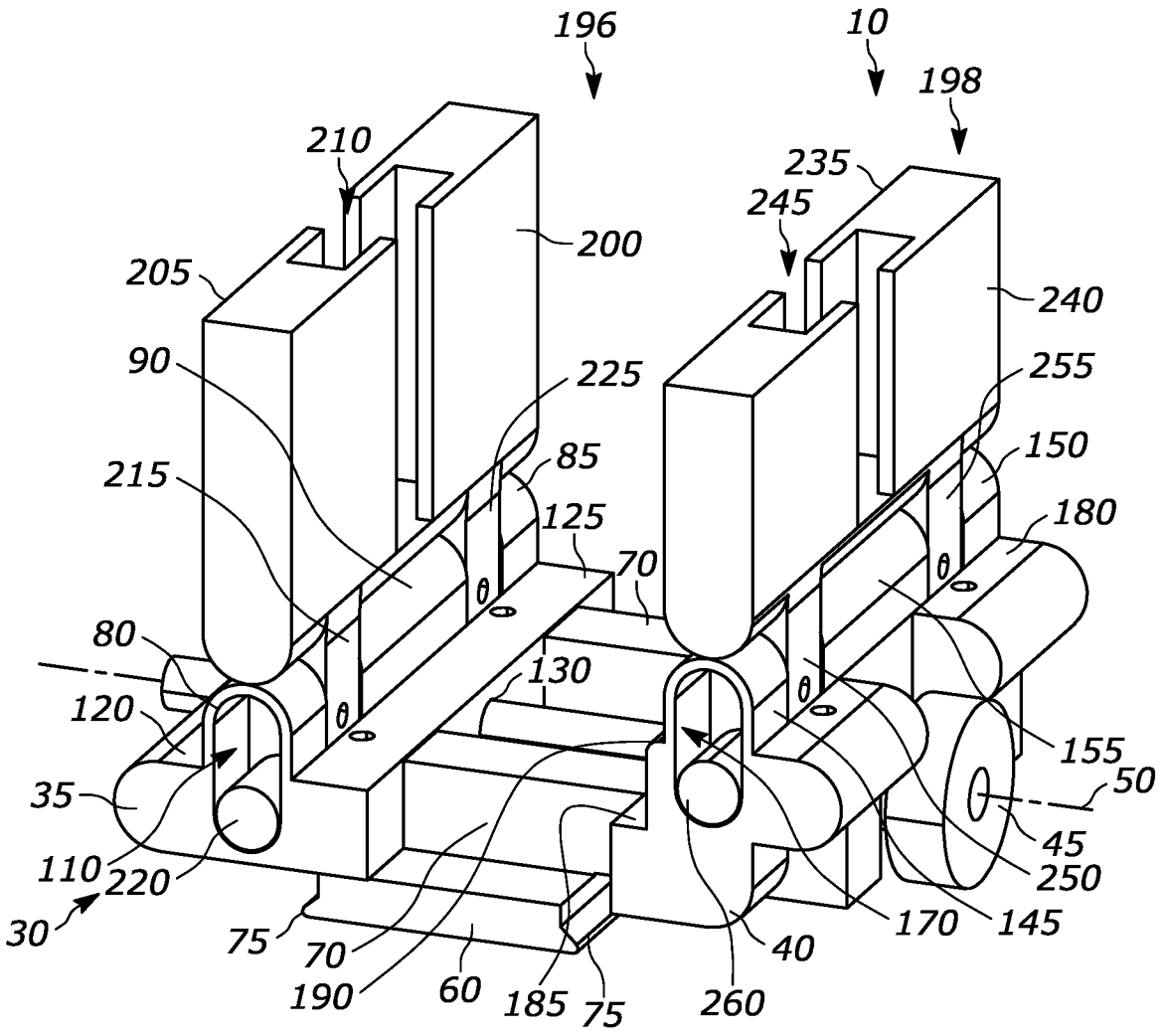
FIG. 3 is a top perspective view of the support mount including wing support members in a first orientation.
Figure 4:
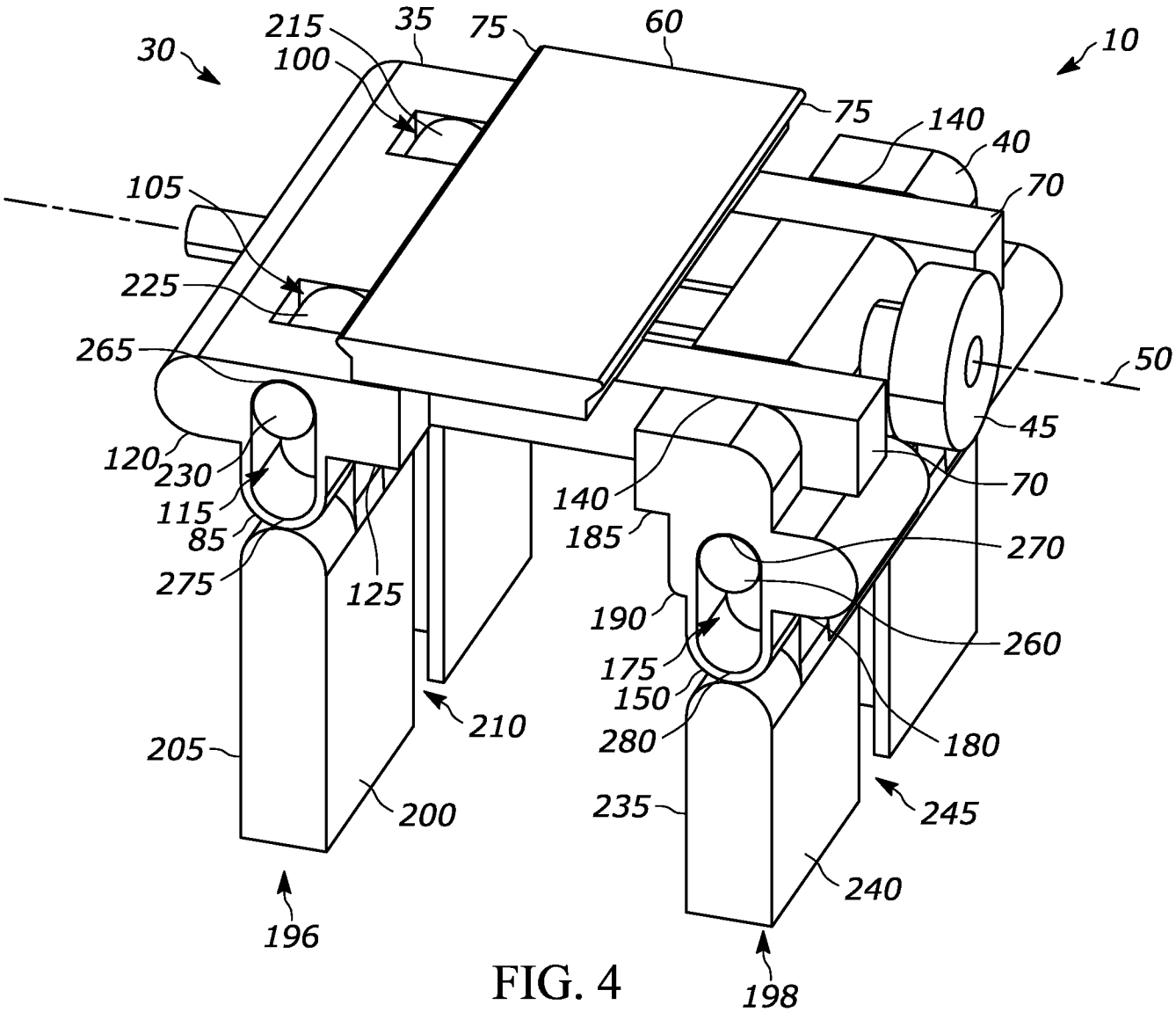
FIG. 4 is a bottom perspective view of the support mount of FIG. 3.
Figure 7:
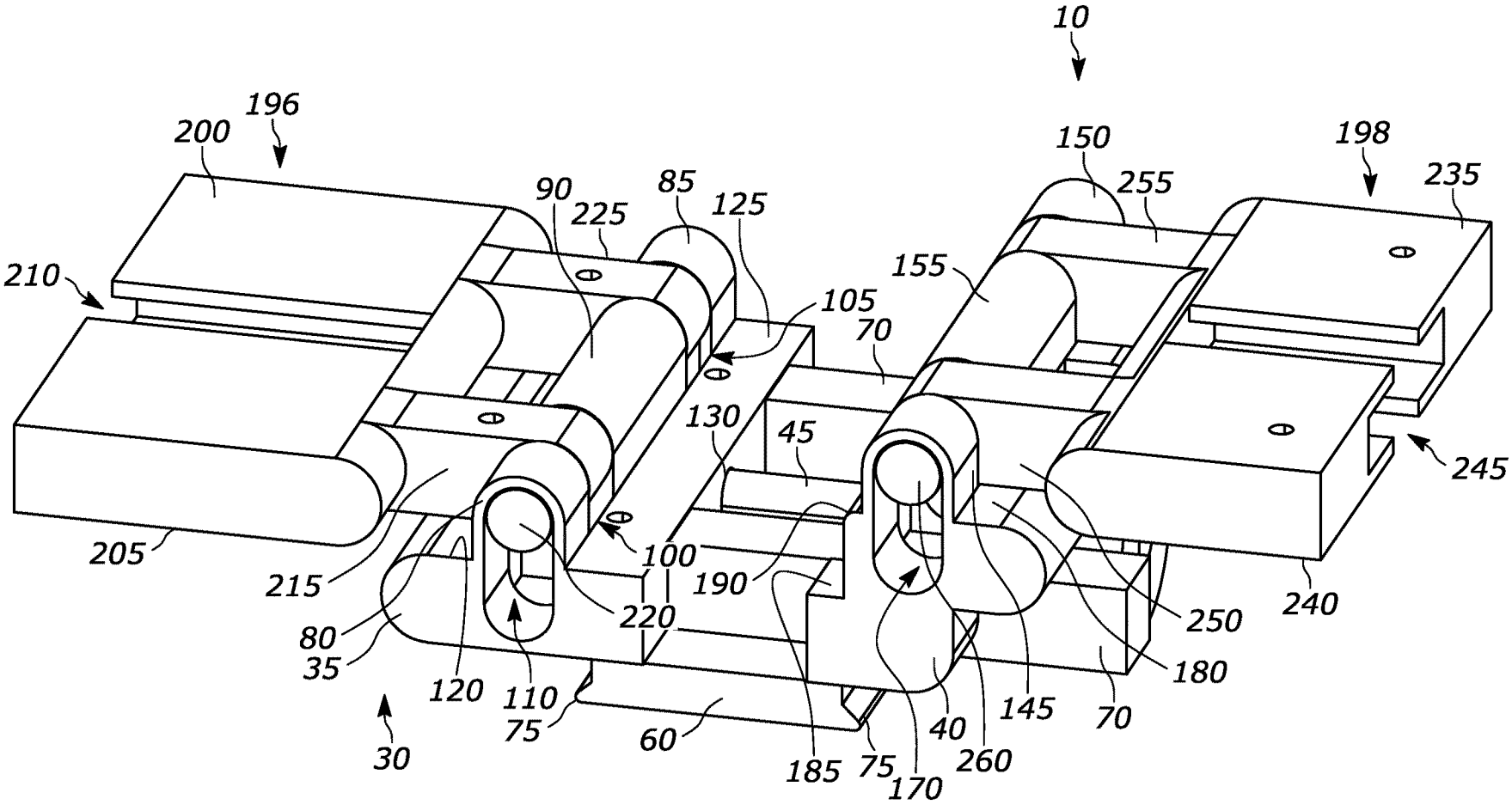
FIG. 7 is a perspective view of the support mount including the wing support members in a second orientation.
Figure 8:
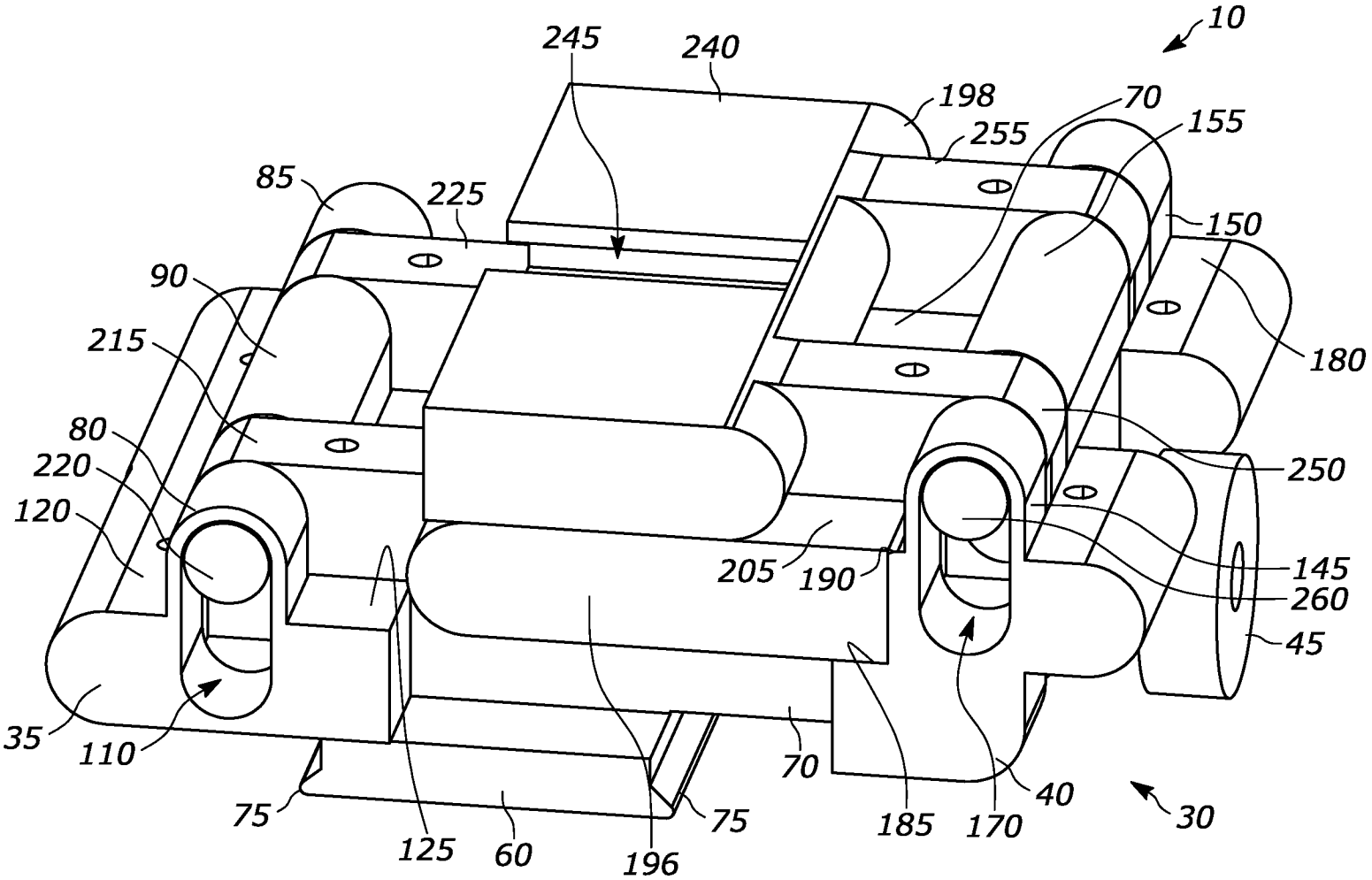
FIG. 8 is a perspective view of the support mount including the wing support members in a third orientation.

With reference to FIGS. 3, 7, and 8, each wing support 196, 198 can be positioned in at least three configurations/orientations relative to the base 30. As shown in FIG. 3, the first and second wing supports 196, 198 are both in a first configuration such that the first surfaces 200, 235 of the first and second wing supports 196, 198 are facing each other, and the second surfaces 205, 240 of the first and second wing supports 196, 198 are facing away from each other. In other words, the first and second wing supports 196, 198 are oriented vertically relative to the longitudinal axis 50. The first and second wing supports 196, 198 are maintained in the first configuration by the first and second wing supports 196, 198 being seated in the body 35 and the slider 40. In particular, the first wing support 196 is seated in the body 35 such that the first and second shafts 220, 230 engage a bottom portion 265 of the first and second base slots 110, 115. As a result, the first and second arms 215, 225 engage walls that define the first and second base cavities 100, 105 such that the first wing support 196 is inhibited from pivoting relative to the body 35. Likewise, the second wing support 198 is seated in the slider 40 such that the shaft 260 engages a bottom portion 270 of the first and second slider slots 170, 175. As a result, the first and second arms 250, 255 engage walls that define the first and second slider cavities 160, 165 such that the second wing support 198 is inhibited from pivoting relative to the slider 40.

The first and second wing supports 196, 198 are both selectively moveable into a second configuration/orientation (e.g., an expanded configuration) as shown in FIG. 7 such that the first and second wing supports 196, 198 are oriented parallel to the longitudinal axis 50. Specifically, to move the first wing support 196 from the first configuration (FIG. 3) to the second configuration (FIG. 7), the first wing support 196 is first moved upwardly in a direction transverse to the longitudinal axis 50 for the first and second shafts 220, 230 to engage a top portion 275 of the first and second base slots 110, 115. As a result, the first wing support 196 is allowed to pivot about the first and second shafts 220, 230 into the second configuration. In this configuration, the first and second arms 215, 225 engage the base stop surface 120 to support the first wing support 196 in the second configuration and to inhibit hyper rotation of the first wing support 196. Likewise, to move the second wing support 198 from the first configuration (FIG. 3) to the second configuration (FIG. 7), the second wing support 198 is first moved upwardly in a direction transverse to the longitudinal axis 50 for the shaft 260 to engage a top portion 280 of the first and second slider slots 170, 175. As a result, the second wing support 198 is allowed to pivot about the shaft 260 into the second configuration. In this configuration, the first and second arms 250, 255 engage the slider stop surface 180 to support the second wing support 198 in the second configuration and to inhibit hyper rotation of the second wing support 198.

The first and second wing supports 196, 198 are both selectively moveable into a third configuration/orientation (e.g., a folded or retracted configuration) as shown in FIG. 8 such that the first and second wing supports 196, 198 are oriented parallel to the longitudinal axis 50. Specifically, to move the first wing support 196 from the second configuration (FIG. 7) to the third configuration (FIG. 8), the first wing support 196 pivots about the first and second shafts 220, 230 for the first surface 200 of the first wing support 196 to engage the top surface of the guide rails 70 and the slider support surface 185. In addition, the first and second arms 215, 225 engage the base support surface 125. In other embodiments, the first surface 200 can also engage the base support surface 125 and/or the first and second arms 215, 225 can engage the guide rails 70. Likewise, to move the second wing support 198 from the second configuration (FIG. 7) to the third configuration (FIG. 8), the second wing support 198 pivots about the shaft 260 for the first surface 235 of the second wing support 198 to engage the second surface 205 of the first wing support 196. In addition, the first and second arms 250, 255 engage the lip 190 of the slider 40.

The illustrated first and second wing supports 196, 198 can also move from the first configuration (FIG. 3) directly into the third configuration (FIG. 8). In addition, the first and second wing supports 196, 198 can be independently positioned in different configurations than the other wing support 196, 198. For example, the first wing support 196 can be in the first, second, or third configuration while the second wing support 198 is in the first, second, or third configuration.

Figure 9:
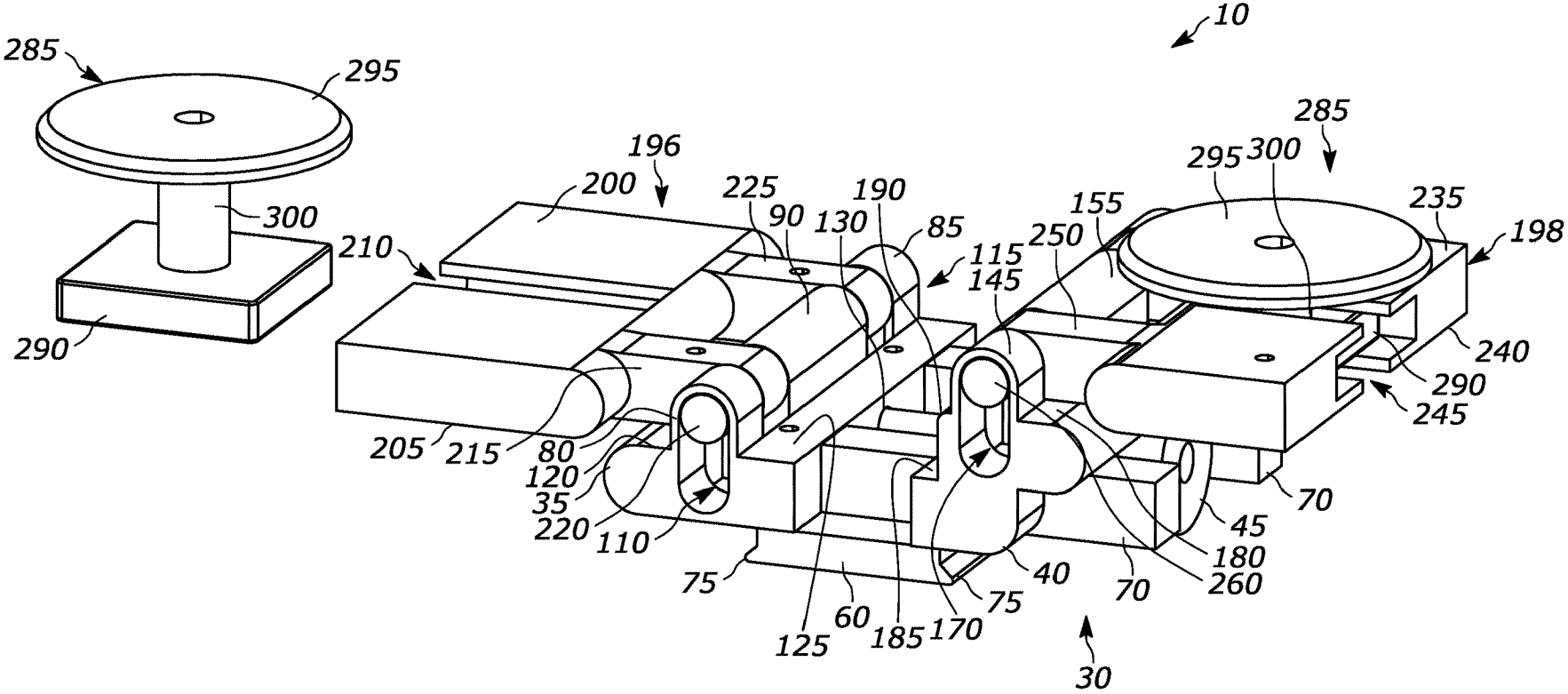
FIG. 9 is a perspective view of the support mount of FIG. 7 including attachment members selectively coupled to the support mount to couple at least one accessory to the support mount.
Figure 10:
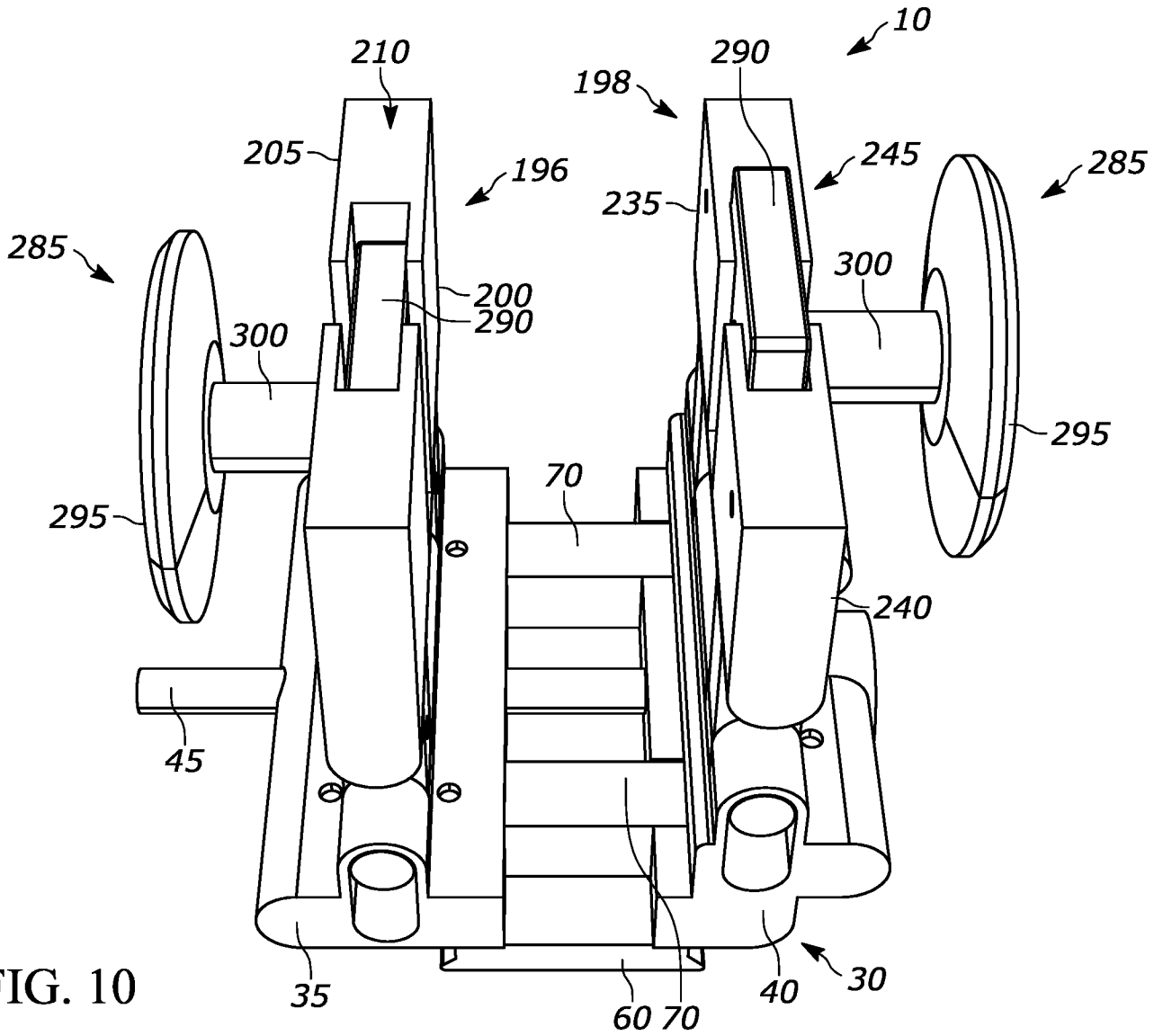
FIG. 10 is a perspective view of the support mount of FIG. 3 including the attachment members selectively coupled to the support mount to couple the at least one accessory to the support mount.

FIGS. 9 and 10 illustrate attachment members 285 selectively coupled to the first and second wing supports 196, 198 to support an accessory (e.g., the optics 25) on the support mount 10. In particular, each attachment member 285 includes an attachment base 290, a platform 295, and a stem 300 coupling the attachment base 290 to the platform 295. The attachment base 290 is sized to be received within the support slots 210, 245 such that the attachment member 285 is non-rotatably coupled to the support mount 10. For example, the attachment base 290 is shaped as a cuboid member to inhibit rotation within the support slots 210, 245. As shown in FIG. 9, both wing supports 196, 198 are positioned in the second configuration with the stems 270 of the attachment members 285 extending through the support slots 210, 245 beyond the first surfaces 200, 235. As shown in FIG. 10, the attachment members 285 can be flipped such that the stems 300 extend through the support slots 210, 245 beyond the second surfaces 205, 240. In other embodiments, the attachment base 290 can include retaining members to inhibit the attachment members 285 from inadvertently sliding out of the support slots 210, 245. For example, the attachment base 290 can include a detent assembly to interface with the support slots 210, 245, the wing supports 196, 198 can include a latch to retain the attachment members 285 to the wing supports 196, 198, magnets can retain the attachment members 285 to the wing supports 196, 198, etc. The illustrated platform 295 enables an accessory (e.g., binoculars, spotting scope, etc.) to be mounted to the attachment member 285 (e.g., by a fastener coupling the accessory to the attachment member 285), which is then coupled to the support mount 10. In other embodiments, the platform 295 can be omitted or selectively removed such that the stem 300 is coupled to the accessory to mount the accessory to the support mount 10. In further embodiments, the attachment members 285 can be differently configured dependent upon the desired accessory to be mounted to the support mount 10.

During operation (e.g., during a hunt), at least one accessory (e.g., the binoculars 25) can be coupled to the support mount 10 while at least one support wing 196, 198 is positioned in the first configuration (FIG. 3), the second configuration (FIG. 7), or the third configuration (FIG. 8).

For example, as shown in FIG. 2, the binoculars 25 is coupled to the attachment member 285, which is coupled to the second support wing 198 when both the first and second wing supports 196, 198 are in the third configuration (FIG. 8). In other embodiments, a plurality of accessories (e.g., a plurality of binoculars 25, a plurality of spotting scopes, the binoculars 25 and a spotting scope, etc.) can be coupled to the support mount 10. For example, the binoculars 25 can be coupled to an attachment member 285, which is coupled to the first wing support 196 when in the first configuration (FIG. 10) or the third configuration (FIG. 9), and the spotting scope can be coupled to another attachment member 285, which is coupled to the second wing support 198 when in the first configuration (FIG. 10) or the third configuration (FIG. 9). The support mount 10 provides many more configurations of mounting an accessory to the support mount 10 not explicitly disclosed herein.

At least one benefit of the illustrated support mount 10 is the ability to quickly be adjusted into the different configurations. For example, the firearm 20 can be quickly mounted on the support mount 10 once a target has been identified through the optics 25. The firearm 20 is supported on the tripod 15 via the support mount 10 (FIG. 1) to provide stability to the firearm 20 during a shot. Specifically, the accessory or accessories are quickly removed from the support mount 10 by sliding the attachment members 285 out of the wing supports 196, 198. The first and second wing supports 196, 198 are then positioned in the first configuration (FIG. 3) and the firearm 20 is placed between the first and second wing supports 196, 198 for the firearm 20 to be at least supported on the guide rails 70. Then, the fastener 45 is rotated in a first direction to move the slider 40 toward the body 35 along the guide rails 70. Ultimately, the first surfaces 200, 235 of the wing supports 196, 198 will contact the firearm 20 (e.g., a stock of the firearm 20), and with continued tightening of the fastener 45, the wing supports 196, 198 clamp the firearm 20 to the support mount 10. As such, the firearm 20 is inhibited from moving relative to the base 30 and the wing supports 196, 198. In some embodiments, the first surfaces 200, 235 can be enhanced to improve the gripping forces of the wing supports 196, 198 on the firearm 20 (e.g., the first surfaces 200, 235 can be textured, include gripping pads, etc.). As the support mount 10 is coupled to the tripod 15, the firearm 20 can be accurately positioned on target by the articulation between the tripod 15 and the support mount 10.

In some embodiments, both the firearm 20 and an accessory 25 can be coupled to the support mount 10 at the same time. For example, while the support mount 10 is coupled to the firearm 20 (FIG. 1), an attachment member 285 can be coupled to a spotting scope and attached to one of the first and second support wings 196, 198. As such, the spotting scope is positioned on a side of the firearm 20. This dual configuration is advantageous while, for example, the firearm 20 is being sighted in on a range. The support mount 10 conveniently locates the spotting scope adjacent the firearm 20 to see placement of a shot on a target by the firearm 20. In other situations, this dual configuration can also be advantageous. For example, a range finder can be coupled to the support mount 10 via an attachment member 285 to determine a distance of a target prior to discharging the firearm 20, a camera can be coupled to the support mount 10 via an attachment member 285 to document the hunt, etc.

To remove the firearm 20 from the support mount 10, the fastener 45 is rotated in a second direction to allow movement of the slider 40 away from the body 35 to ultimately move the support wings 196, 198 away from each other. Once the clamping force of the support mount 10 on the firearm 20 subsides, the firearm 20 can be removed from the support mount 10. In some embodiments, a mechanism (e.g., a pin, etc.) can couple the fastener 45 to the slider 40 such that the slider 40 axially moves with the fastener 45 along the longitudinal axis 50 as the fastener 45 rotates in either rotational direction. In other embodiments, the fastener 45 can abut the slider 40 to move the slider 40 toward the body 35 as the fastener 45 is rotated in the first direction, and can be spaced from the slider 40 as the fastener 45 is rotated in the second direction to allow manual movement of the slider 40 away from the body 35. In further embodiments, the slider 40 can be spring biased away from the body 35 such that the slider 40 automatically moves away from the body 35 when the fastener 45 is loosened.

FIGS. 11-18 illustrate a support mount 400 according to another embodiment. The support mount 400 is similar to the support mount 10 as shown in FIGS. 1-10. At least some differences and/or at least some similarities between the support mounts 10, 400 will be discussed in detail below. In addition, components or features described with respect to the support mount 400 are equally applicable to the support mount 10 and vice versa.

Figure 11:
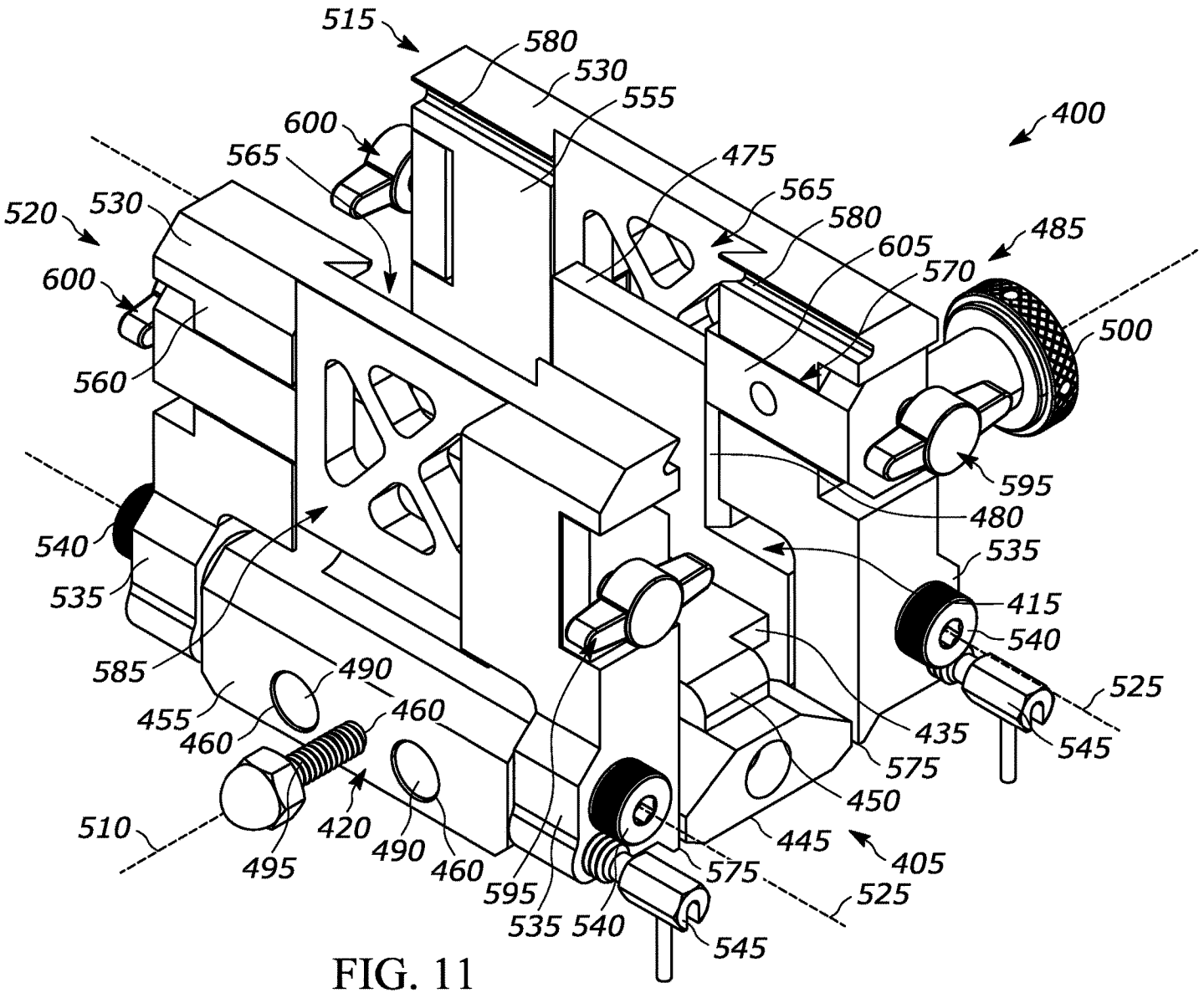
FIG. 11 is a perspective view of a support mount according to another embodiment including platforms positioned in vertical orientations.
Figure 12:
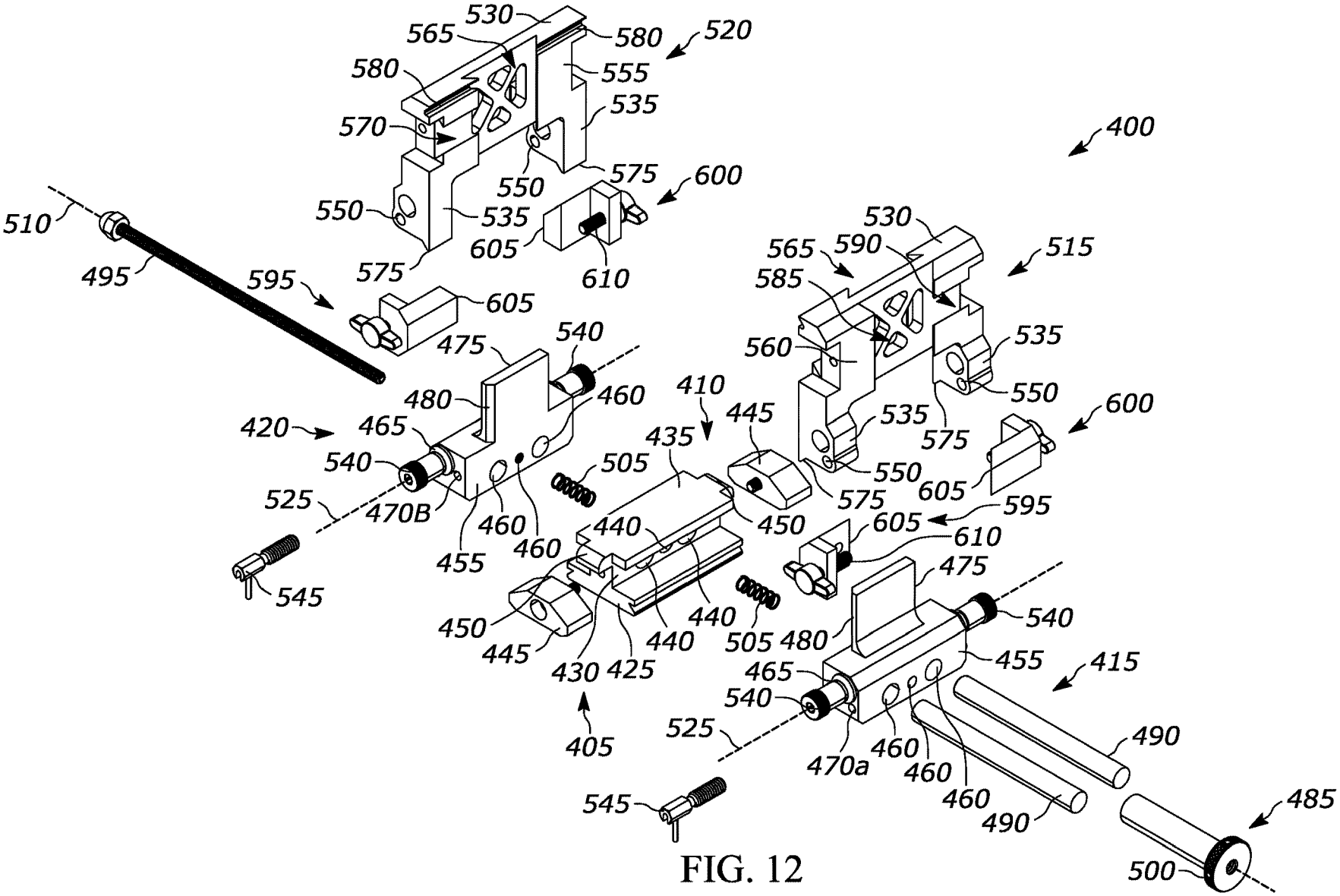
FIG. 12 is a first exploded view of the support mount of FIG. 11.
Figure 13:
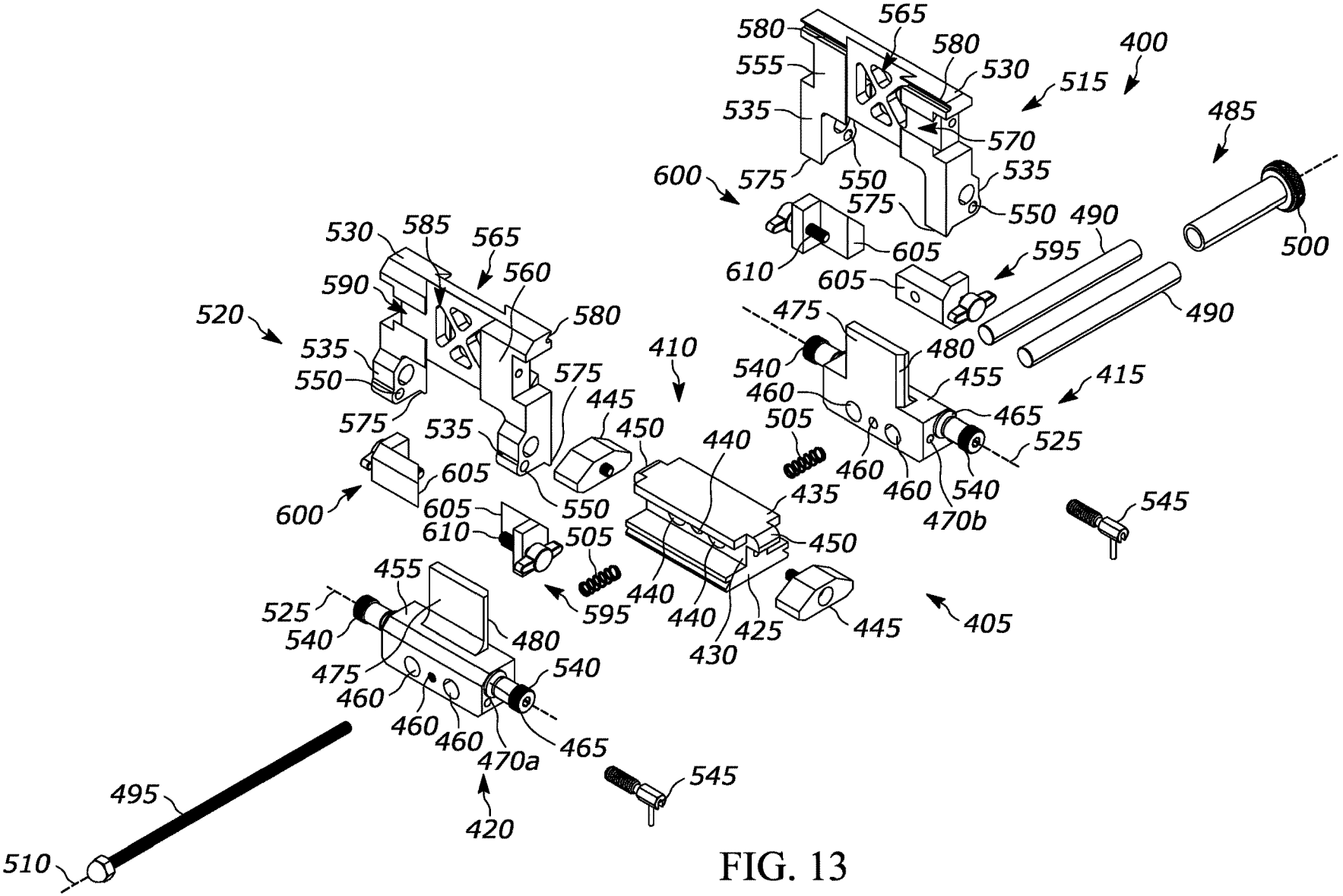
FIG. 13 is a second exploded view of the support mount of FIG. 11.
Figure 14:
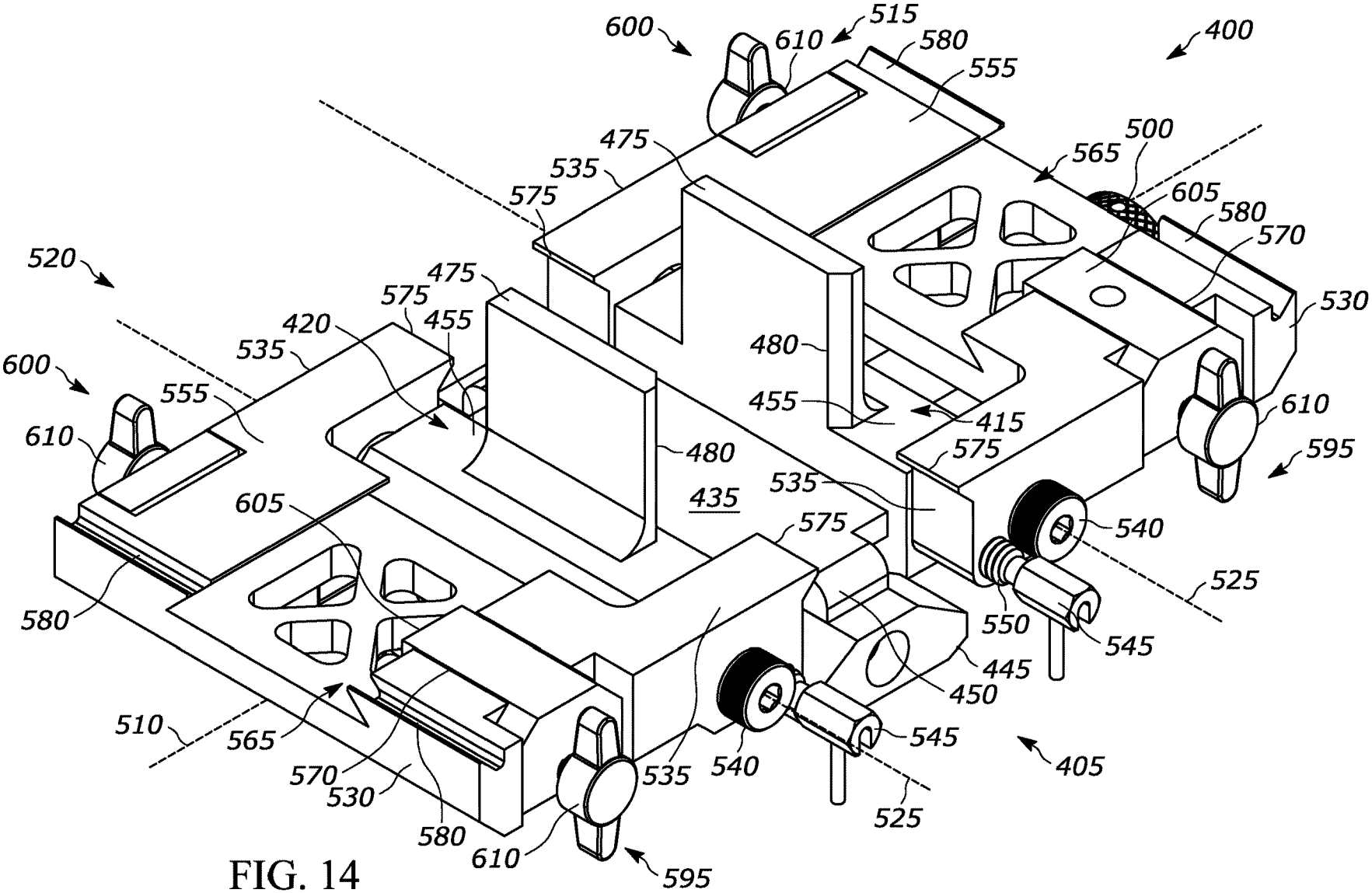
FIG. 14 is a perspective view of the support mount of FIG. 11 including the platforms positioned in horizontal orientations.

The illustrated support mount 400 is selectively coupled to a support stand (e.g., the tripod 15; FIG. 1). With reference to FIGS. 11-13, the support mount 400 includes a base assembly 405 having a stand attachment member 410, a first base member 415, and a second base member 420. The stand attachment member 410 includes a universal attachment member 425 or dovetail protrusion (similar to the universal attachment member 60 as discussed above), a vertical wall 430 extending upwardly from the universal attachment member 425, and a horizontal support wall 435 extending upwardly from the vertical wall 430. The vertical wall 430 includes alignment apertures 440 extending therethrough. In the illustrated embodiment, the vertical wall 430 includes three apertures 440. In addition, the base assembly 405 includes stops 445 coupled to lateral sides of the vertical wall 430. In the illustrated embodiment, the stops 445 are coupled to the vertical wall 430 by fasteners, and a top surface of the stops 445 are engageable with tabs 450 extending from the support wall 435 to inhibit the stops 445 from moving (e.g., pivoting) relative to the stand attachment member 410. The illustrated stops 445 are removable from the base assembly 405 by removing the fasteners. In other embodiments, the stops 445 can be formed integral with the vertical wall 430 to be formed as one piece with the stand attachment member 410.

The illustrated first base member 415 and the second base member 420 are constructed to be similar, and as such, features of the first base member 415 are discussed below but are equally applicable to the features of the second base member 420. With continued reference to FIGS. 11-13, the first base member 415 includes a body 455 having alignment apertures 460 extending through the body 455 that align with the alignment apertures 440 of the stand attachment member 410. In addition, each lateral side of the body 455 includes a pivot aperture 465 and locating apertures 470*a*, 470*b* with the locating apertures 470*a*, 470*b* positioned at the same radial distance relative to the pivot aperture 465. In other embodiments, the first base member 415 can include one pivot aperture 465 that extends through the body 455. In further embodiments, only one lateral side of the body 455 can include the locating apertures 470*a*, 470*b*. The first base member 415 also includes a vertical clamping wall 475 extending upwardly from the body 455. The vertical clamping wall 475 includes a beveled edge 480 formed on an inboard lateral side of the vertical clamping wall 475. In other embodiments, the vertical clamping wall 475 can be omitted.

The base assembly 405 also includes an adjustment subassembly 485 that couples the stand attachment member 410, the first base member 415, and the second base member 420 together. In particular, the adjustment subassembly 485 includes guide rails 490 that are received through the alignment apertures 440, 460 of the stand attachment member 410, the first base member 415, and the second base member 420. In the illustrated embodiment, the adjustment subassembly 485 includes two guide rails 490 that are received through two of the alignment apertures 440, 460. The guide rails 490 are fixed to the second base member 420 and are slidably coupled to the first base member 415 and the stand attachment member 410. In other embodiments, the guide rails 490 can be fixed to the first base member 415 and slidably coupled to the second base member 420 and the stand attachment member 410. In further embodiments, the adjustment subassembly 485 can include one or more than two guide rails 490.

In addition, the adjustment subassembly 485 includes a threaded shaft 495 coupled to an adjustment knob 500 with the threaded shaft 495 received through the alignment apertures 440, 460 of the stand attachment member 410, the first base member 415, and the second base member 420. In the illustrated embodiment, the threaded shaft 495 is positioned between the two guide rails 490 and threadably engages an alignment aperture 460 of the second base member 420. The alignment apertures 460 of the first base member 415 and the stand attachment member 410 that receives the threaded shaft 495 are smooth bore alignment apertures 460. In addition, the threaded shaft 495 extends through biasing members (e.g., compression springs 505) with a first spring 505 positioned between the vertical wall 430 and the first base member 415 and a second spring 505 positioned between the vertical wall 430 and the second base member 420. The springs 505 bias the first base member 415 and the second base member 420 away from the stand attachment member 410 in directions along a longitudinal axis 510 of the threaded shaft 495. The illustrated adjustment knob 500 is operable to rotate the threaded shaft 495 to selectively adjust a distance, parallel to the longitudinal axis 510, between the first base member 415 and the second base member 420 discussed in more detail below.

With continued reference to FIGS. 11-13, the illustrated support mount 400 also includes a first platform 515 moveably coupled to the first base member 415 and a second platform 520 movably coupled to the second base member 420. In particular, the first platform 515 and the second platform 520 are pivotably coupled to the first base member 415 and the second base member 420, respectively, about pivot axes 525 oriented perpendicular to the longitudinal axis 510 of the threaded shaft 495. The illustrated first platform 515 and the second platform 520 are constructed to be similar, and as such, features of the first platform 515 are discussed below but are equally applicable to the features of the second platform 520.

The first platform 515 includes a body 530 and two legs 535 extending from the body 530 such that the body 530 and the two legs 535 define a cavity that receives the first base member 415. Pivot hubs 540 are received through apertures extending through the legs 535 such that the pivot hubs 540 engage the pivot apertures 465 of the first base member 415. In the illustrated embodiment, the pivot apertures 465 are threaded to engage threads of the pivot hubs 540 to fix the pivot hubs 540 to the first base member 415, and the first platform 515 is pivotable about a portion of the pivot hubs 540 extending from the lateral sides of the first base member 415. As discussed above, the pivot apertures 465 can be one through aperture of the first base member 415, and in this embodiment, the support mount 400 can include one pivot hub that extends between the two legs 535. In addition, a platform locking member 545 (e.g., platform supporting member) is coupled to one leg 535 of the first platform 515 to be received within one of the locating apertures 470*a*, 470*b* of the first base member 415 to secure the first platform 515 in a desired position relative to the first base member 415. In particular, the platform locking member 545 is a partially threaded pin that threadably engages a lock aperture 550 formed through the leg 535. The pin is operable to selectively secure the first platform 515 in a first/vertical orientation (FIG. 11) or a second/horizontal orientation (FIG. 14) discussed in more detail below. In other embodiments, the first platform 515 can include two or more platform locking members 545 to selectively secure the first platform 515 in the vertical orientation or the horizontal orientation. For example, the first platform 515 can include one platform locking member 545 on each lateral side of the first platform 515.

The illustrated first platform 515 also includes a first side 555 and a second side 560 opposite the first side 555. The first side 555 includes a first mounting dovetail slot 565 having a longitudinal axis oriented perpendicular to the pivot axis 525 and a first locking dovetail slot 570 having a longitudinal axis oriented parallel to the pivot axis 525. The first locking dovetail slot 570 is in communication with the first mounting dovetail slot 565. The first side 555 also includes ribs 575 protruding from ends of the legs 535 and notches 580 formed adjacent an end portion of the body 530. The illustrated second side 560 includes a second mounting dovetail slot 585 having a longitudinal axis oriented perpendicular to the pivot axis 525 and a second locking dovetail slot 590 having a longitudinal axis oriented parallel to the pivot axis 525. The second locking dovetail slot 590 is in communication with the second mounting dovetail slot 585. In addition, the first and second mounting dovetail slots 565, 585 are positioned between the first locking dovetail slot 570 and the second locking dovetail slot 590 in a direction parallel to the pivot axis 525.

The first platform 515 also includes a first locking member 595 and a second locking member 600. Each locking member 595, 600 includes a dovetail protrusion 605. The dovetail protrusion 605 of the first locking member 595 is received within the first locking dovetail slot 570, and the dovetail protrusion 605 of the second locking member 600 is received within the second locking dovetail slot 590. The first locking member 595 and the second locking member 600 also include a fastener 610 that couples the first locking member 595 and the second locking member 600 to the first platform 515. In the illustrated embodiment, the fastener 610 is a threaded fastener that threadably engages the body 530 of the first platform 515 and includes a gripping portion that is operable to rotate the fastener 610.

As discussed above, the first platform 515 and the second platform 520 can be secured in either the vertical orientation or the horizontal orientation. In the illustrated embodiment, the vertical orientation of the first platform 515 and the second platform 520 is such that at least one of the first and second sides 555, 560 is oriented substantially perpendicular to the longitudinal axis 510, and the horizontal orientation of the first platform 515 and the second platform 520 is such that at least one of the first and side sides 555, 560 is oriented substantially parallel to the longitudinal axis 510. In other embodiments, the vertical orientation and the horizontal orientation of the first platform 515 and the second platform 520 can be oriented differently relative to the longitudinal axis 510. For example, the first platform 515 can be positioned in at least two positions, one of which is more vertical than the other position relative to the longitudinal axis 510. Likewise, the second platform 520 can be positioned in at least two positions, one of which is more vertical than the other position relative to the longitudinal axis 510.

Movement between the vertical and horizontal orientations is substantially the same between the first platform 515 and the second platform 520. As such, movement of the first platform 515 between the vertical and horizontal orientations is discussed in detail below but is also applicable to movement of the second platform 520 between the vertical and horizontal orientations. To secure the first platform 515 in the vertical orientation (FIG. 11), the first platform 515 is rotated about the pivot axis 525 for the platform locking member 545 to align with the lower/outboard locating aperture 470*a* of the first base member 415. By rotating the platform locking member 545 in a tightening direction, a tip (e.g., an unthreaded portion) of the platform locking member 545 is received within the lower/outboard locating aperture 470*a* to inhibit the first platform 515 from movement about the pivot axis 525 and secure the first platform 515 in the vertical orientation. In addition, the vertical clamping wall 475 of the first base member 415 can be coupled to the first platform 515 to also fix the first platform 515 in the vertical orientation. In particular, the vertical clamping wall 475 is received within the first mounting dovetail slot 565 for the bevel edge 480 of the vertical clamping wall 475 to at least partially align with the first locking dovetail slot 570. The first locking member 595 is tightened to the first platform 515 for the dovetail protrusion 605 of the first locking member 595 to engage the bevel edge 480. Engagement between the first locking member 595 and the vertical clamping wall 475 inhibits the first platform 515 from movement about the pivot axis 525 to also secure the first platform 515 in the vertical orientation.

To move the first platform 515 from the vertical orientation (FIG. 11) to the horizontal orientation (FIG. 14), the first locking member 595 is loosened to disengage from the bevel edge 480 and the platform locking member 545 is also loosened to be spaced from the first base member 415. Accordingly, the first platform 515 can be rotatable about the pivot axis 525 into the horizontal orientation such that the platform locking member 545 aligns with the upper/inboard locating aperture 470*b*. By rotating the platform locking member 545 in a tightening direction, the tip of the platform locking member 545 is received within the upper/inboard locating aperture 470*b* to secure the first platform 515 in the horizontal orientation. In some embodiments, the stops 445 can be removed for the first platform 515 to pivot into the horizontal orientation. In other embodiments, the stops 445 can remain coupled to the stand attachment member 410 and the adjustment knob 500 can be rotated to allow for enough clearance between the first platform 515 and the stops 445 for the first platform 515 to pivot into the horizontal orientation.

In other embodiments, the platform locking member 545 can operate in a different manner to lock or unlocked the first platform 515 relative to the first base member 415. For example, the platform locking member 545 can be a biased pull pin that is biased in a direction for the pin to be received within the locating apertures 470*a*, 470*b* to secure the first platform 515 in either the vertical orientation or the horizontal orientation. Upon axially pulling the pin away from the first base member 415, the pin can be spaced from the locating apertures 470*a*, 470*b* allowing the first platform 515 to pivot about the pivot axis 525.

As also discussed above, the adjustment knob 500 is operable to adjust a distance between first base member 415 and the second base member 420 along the longitudinal axis 510 of the threaded shaft 495. Accordingly, the adjustment knob 500 is also operable to adjust a distance between the first platform 515 and the second platform 520 (in either the vertical orientation and/or the horizontal orientation) as the first platform 515 and the second platform 520 are pivotably coupled to the first base member 415 and the second base member 420, respectively, about the pivot axes 525. Upon rotation of the adjustment knob 500 in a first rotational direction, the adjustment knob 500 rotates the threaded shaft 495 to move the first base member 415 and the second base member 420 away from each other (e.g., the distance between the vertical clamping walls 475 of the first base member 415 and the second base member 420 increases). In other words, the threaded engagement between the threaded shaft 495 and the alignment aperture 460 of the second base member 420 moves the second base member 420 along the longitudinal axis 510 relative to the first base member 415 and the stand attachment member 410 upon rotation of the adjustment knob 500 in the first rotational direction. Conversely, the threaded shaft 495 moves the first base member 415 and the second base member 420 toward each other when the adjustment knob 500 is rotated in a second rotational direction (e.g., the distance between the vertical clamping walls 475 of the first base member 415 and the second base member 420 decreases). In other words, the threaded engagement between the threaded shaft 495 and the alignment aperture 460 of the second base member 420 moves the second base member 420 along the longitudinal axis 510 relative to the first base member 415 and the stand attachment member 410 upon rotation of the adjustment knob 500 in the second rotational direction. Moreover, the springs 505 are operable to bias the first base member 415 and the second base member 420 away from the stand attachment member 410 at equal distances such that the stand attachment member 410 (e.g., the horizontal support wall 435) remains centered between the first base member 415 and the second base member 420 during rotation of the adjustment knob 500.

During operation, the support mount 400 can support a firearm 20 on the stand 15 to stabilize the firearm 20 during a discharge of the firearm 20. The adjustment knob 500 is rotated to increase the distance between the first base member 415 and the second base member 420 to allow for the firearm 20 to be positioned between the vertical clamping walls 475 of the first base member 415 and the second base member 420. In particular, the firearm 20 is placed on the supporting wall 435 of the stand attachment member 410 for the firearm 20 to be vertically supported on the support mount 400. The adjustment knob 500 is then rotated to decrease the distance between the first base member 415 and the second base member 420 causing the vertical clamping walls 475 of the first base member 415 and the second base member 420 to clamp onto the firearm 20. The adjustment knob 500 is rotated a desired amount to provide a desired clamping force against the firearm 20. Accordingly, the firearm 20 is fixed to the support mount 400, and the firearm 20 and the support mount 400 can move together relative to the stand 15 to accurately aim and discharge the firearm 20.

In other embodiments, the adjustment subassembly 485 can be configured differently. For example, the adjustment knob 500 can be replaced with a lever including a cam surface coupled to an end of the threaded shaft 495, and a nut coupled to the opposite end of the threaded shaft 495. In one embodiment, the lever is positioned adjacent the first base member 415 and the nut is positioned adjacent the second base member 420. To clamp the firearm 20 between the vertical clamping walls 475, the nut is tightened onto the threaded shaft 495 (when the lever is in an unlocked position). Once the nut is relatively tight on the threaded shaft 495 against the second base member 420, the lever is pivoted into a locked position causing the cam surface to apply additional tension on the threaded shaft 495 to provide a desired clamping force of the vertical clamping walls 475 against the firearm 20.

Figure 17:
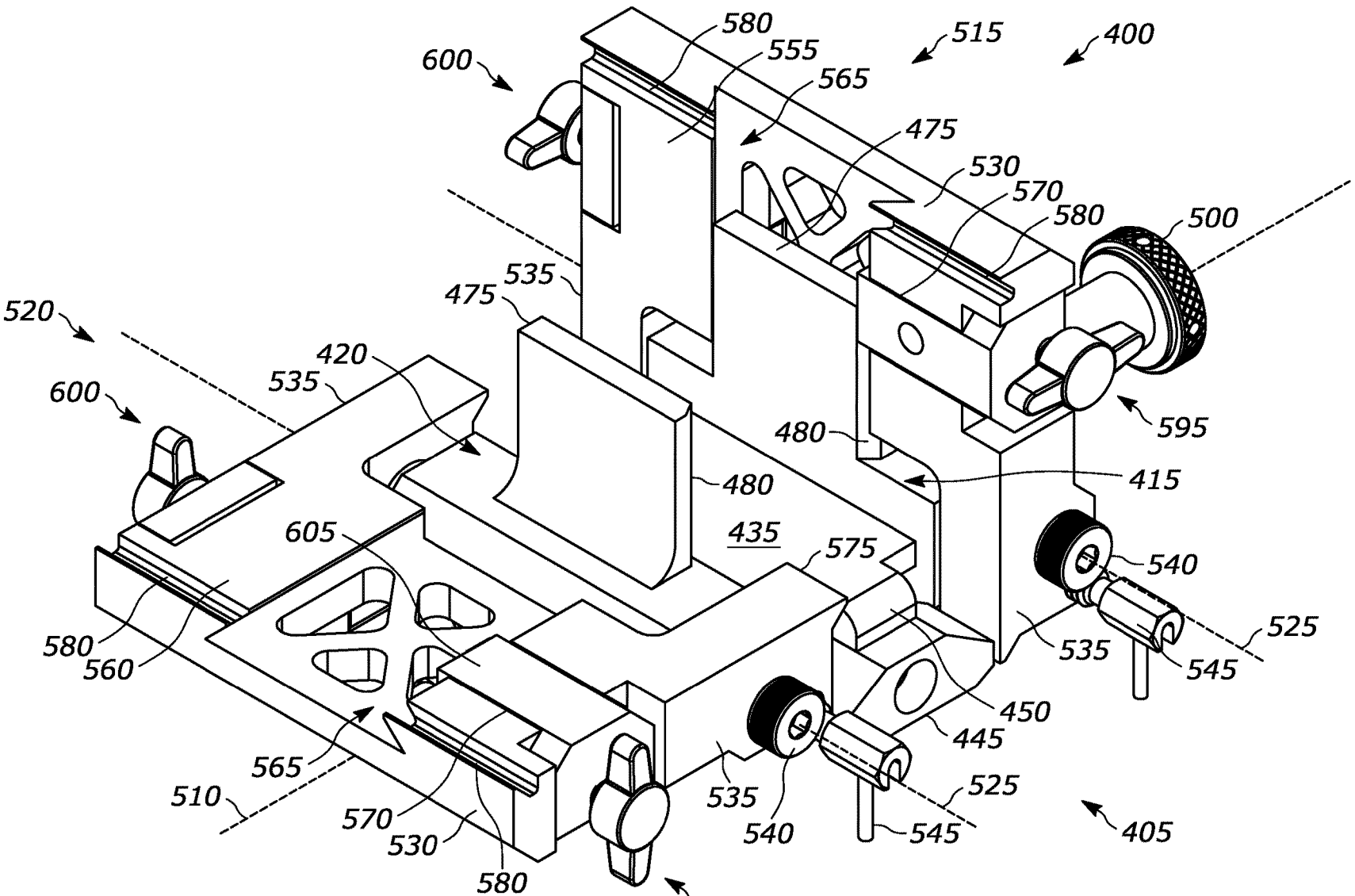
FIG. 17 is a perspective view of the support mount of FIG. 11 including one platform positioned in the vertical orientation and the other platform positioned in the horizontal orientation.

The first platform 515 and the second platform 520 can be positioned in either the vertical orientation (FIG. 11) or the horizontal orientation (FIG. 14), also see FIG. 17, while the firearm 20 is fixed to the support mount 400. When the first platform 515 and/or the second platform 520 is in the vertical orientation, at least a portion of the first side 555 of the first platform 515 and/or the second platform 520 can engage the firearm 20 to also clamp the firearm 20 to the support mount 400. In the embodiment that omits the vertical clamping walls 475, the first platform 515 and the second platform 520 are both positioned in the vertical orientations for the first sides 555 of the first platform 515 and the second platform 520 to clamp the firearm 20 to the support mount 400.

Figure 15:
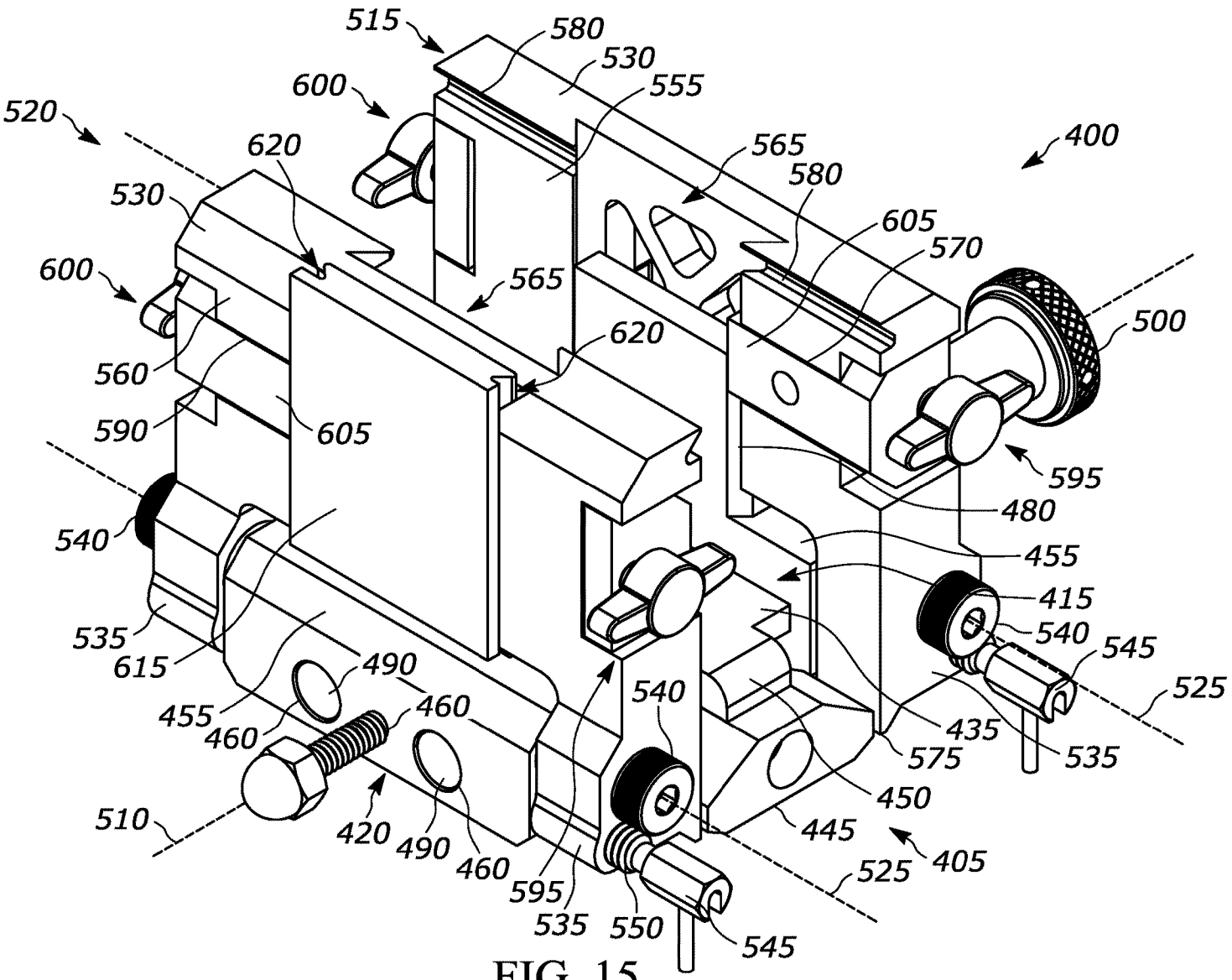
FIG. 15 is a perspective view of the support mount of FIG. 11 including the platforms positioned in the vertical orientations with one of the platforms supporting an attachment member.
Figure 16:
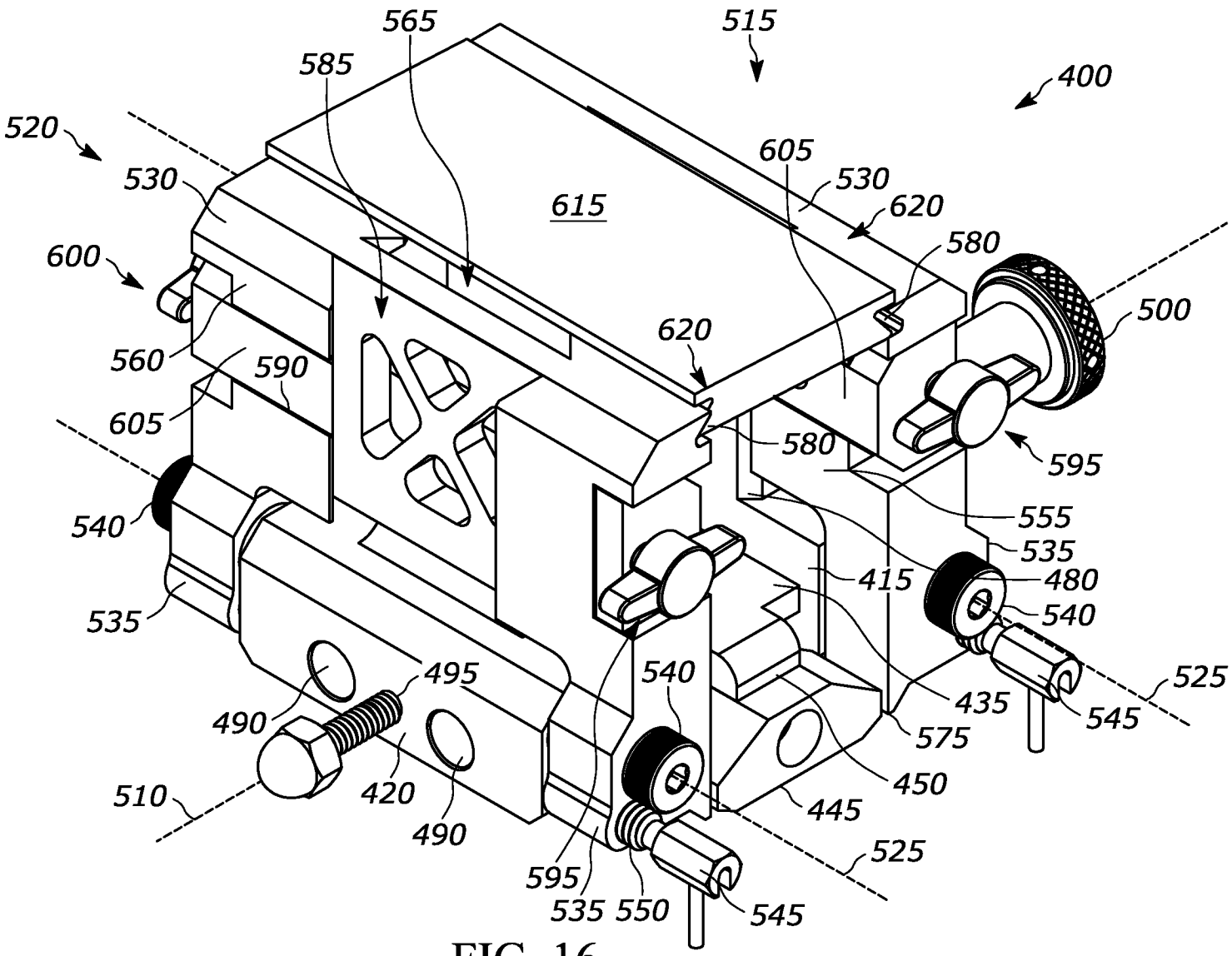
FIG. 16 is a perspective view of the support mount of FIG. 11 including the platforms positioned in the vertical orientations with an attachment member supported between the platforms.

Moreover, the accessory 25 (FIG. 2) can be coupled to the support mount 400 while the firearm 20 is coupled to the support mount 400. In other embodiments, the accessory 25 can be coupled to the support mount 400 without the firearm 20 coupled to the support mount 400. The accessory 25 is coupled to the support mount 400 by an attachment member 615 (FIGS. 15 and 16). In the illustrated embodiment, the attachment member 615 is an Arca-Swiss plate having dovetail protrusions 620 that engage the dovetail features of the support mount 400. The attachment member 615 also includes an attachment feature (e.g., threaded aperture, slot, etc. —not shown) that directly couples to the accessory 25 for the accessory 25 to be coupled to the support mount 400. The attachment member 615 can be coupled to the first side 555 of the second platform 520 (FIGS. 14 and 17) by inserting the attachment member 615 within the first mounting dovetail slot 565, and upon tightening the first locking member 595, the dovetail protrusion 605 of the first locking member 595 engages one dovetail protrusion 620 of the attachment member 615 to fix the attachment member 615 to the second platform 520. In addition, the attachment member 615 can be coupled to the second side 560 of the second platform 520 (FIG. 15) by inserting the attachment member 615 within the second mounting dovetail slot 585, and upon tightening the second locking member 600, the dovetail protrusion 605 of the second locking member 600 engages one dovetail protrusion 620 of the attachment member 615 to fix the attachment member 615 to the second platform 520. The attachment member 615 can be coupled to the first side 555 or the second side 560 of the first platform 515 in a similar manner. In addition, a plurality of attachment members 615 can be coupled to the support mount 400. For example, a first attachment member 615 can be coupled to the second side 560 of the first platform 515 and a second attachment member 615 can be coupled to the second side 560 of the second platform 520 when both the first platform 515 and the second platform 520 are in the vertical orientation (FIG. 15), a first attachment member 615 can be coupled to the first side 555 of the first platform 515 and a second attachment member 615 can be coupled to the first side 555 of the second platform 520 when both the first platform 515 and the second platform 520 are in the horizontal orientation (FIG. 14), a first attachment member 615 can be coupled to the second side 560 of the first platform 515 when in the vertical orientation and a second attachment member 615 can be coupled to the first side 555 of the second platform 520 when in the horizontal orientation (FIG. 17), etc.

In addition, the attachment member 615 can be coupled to the support mount 400 when the firearm 20 is not coupled to the support mount 400. For example, the attachment member 615 can be coupled between the first platform 515 and the second platform 520. When both the first platform 515 and the second platform 520 are in the horizontal orientation (FIG. 14), the attachment member 615 can be positioned between the vertical clamping walls 475 of the first base member 415 and the second base member 420 for the dovetail protrusions 620 of the attachment member 615 to engage the ribs 575 of the first platform 515 and the second platform 520. In particular, actuation of the adjustment knob 500 allows for a sufficient gap between the ribs 575 of the first platform 515 and the second platform 520 to position the attachment member 615 between the first platform 515 and the second platform 520. Then, reverse actuation of the adjustment knob 500 moves the ribs 575 into engagement with the dovetail protrusions 620 of the attachment member 615 to clamp the attachment member 615 between the first platform 515 and the second platform 520. In other embodiments, at least another attachment member can be coupled to the first platform 515 or the second platform 520 (e.g., via the first mounting dovetail slot 565) when the attachment member 615 engages the ribs 575.

With reference to FIG. 16, the attachment member 615 can be coupled between the first platform 515 and the second platform 520 via the notches 580. In particular, actuation of the adjustment knob 500 allows for a sufficient gap between the notches 580 of the first platform 515 and the second platform 520 to position the attachment member 615 between the first platform 515 and the second platform 520. Then, reverse actuation of the adjustment knob 500 moves the notches 580 into engagement with the dovetail protrusions 620 of the attachment member 615 to clamp the attachment member 615 between the first platform 515 and the second platform 520. Moreover, the first platform 515 and the second platform 520 can engage the stops 445 when the attachment member 615 is tightened between the notches 580 of the first platform 515 and the second platform 520. The engagement between the first platform 515, the second platform 520, and the stops 445 reduces shear forces applied to the platform locking members 545 as the attachment member 615 is clamped between the notches 580 of the first platform 515 and the second platform 520. In particular, as the adjustment knob 500 is tightened to clamp the attachment member 615 between the first platform 515 and the second platform 520, the clamping forces act to move the first platform 515 and the second platform 520 about their pivot axes 525 away from each other. This causes the legs 535 of the first platform 515 and the second platform 520 to be biased into the stops 445, and the moment forces about the pivot axes 525 due to the clamping forces on the attachment member 615 act against the stops 445. As a result, the moment forces do not act as a shearing force on the platform locking members 545. In addition, the first locking members 545 can be tightened onto the vertical clamping walls 475 of the first base member 415 and the second base member 420 to help absorb the moment forces created by clamping the attachment member 615 about the pivot axes 525.

In other embodiments, the platform locking members 545 can be positioned at different locations on the support mount 400 to reduce the shearing forces on the platform locking members 545 when the attachment member 615 is clamped via the notches 580. For example, each platform locking member 545 can be positioned between the corresponding pivot axis 525 and the corresponding notch 580 (e.g., located above the corresponding pivot axis 525 when the first platform 515 and the second platform 520 are in the vertical orientation). Such a position of the platform locking members 545 is closer to the clamping forces against the attachment member 615 when clamped between the notches 580 to reduce the shear forces on the platform locking members 545.

In another embodiment of the support mount 400 (FIG. 18), the first base member 415 and the second base member 420 can include first projections 625 and second projections 630 extending away from the stand attachment member 410. Each projection 625, 630 at least partially defines a recess 635. The recesses 635 of the first projections 625 are positioned below the recesses 635 of the second projections 630.

Figure 18:
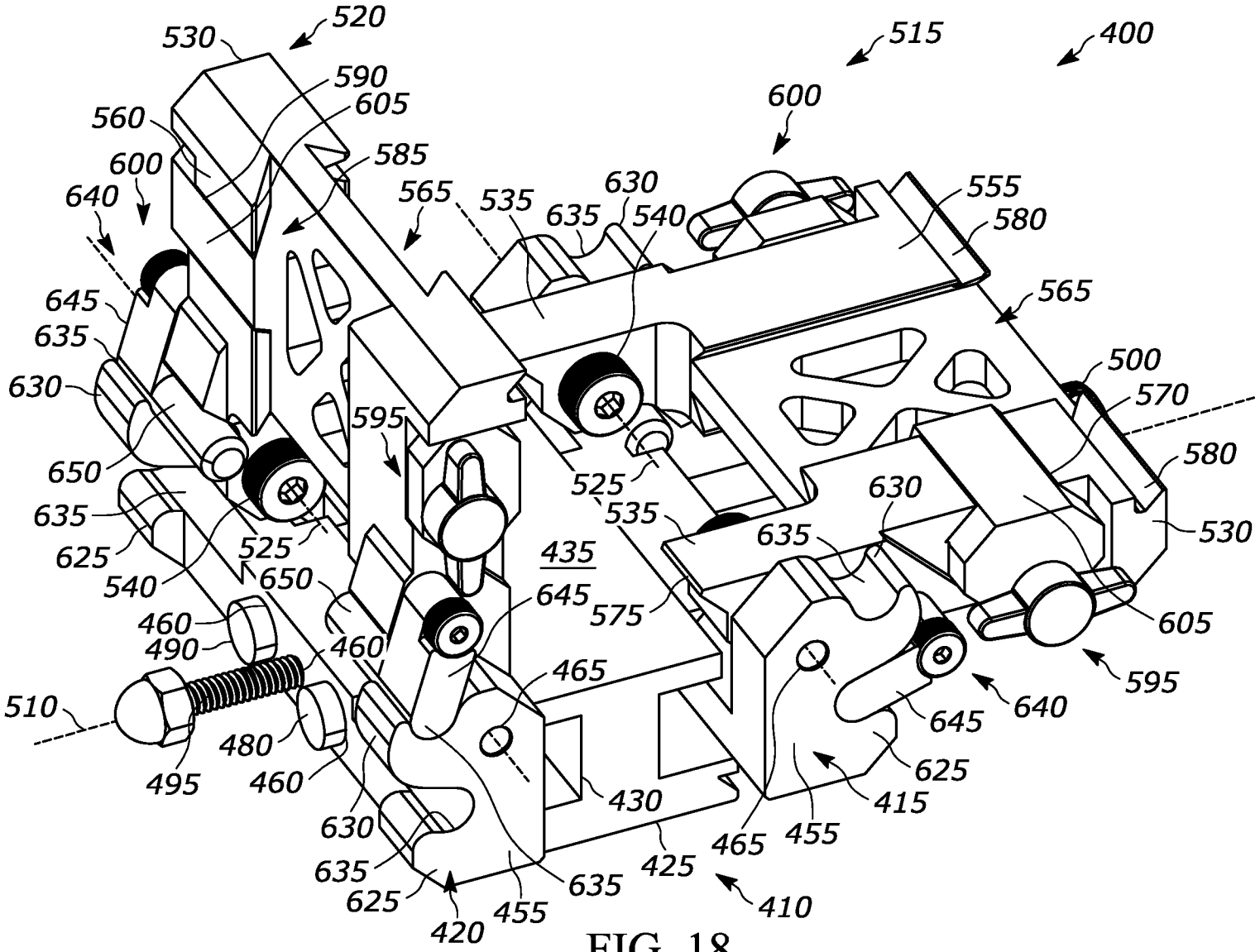
FIG. 18 is a perspective view of the support mount of FIG. 11 according to another embodiment including one platform positioned in the vertical orientation and the other platform positioned in the horizontal orientation.

With continued reference to FIG. 18, the first platform 515 and the second platform 520 include platform supporting members 640 (e.g., platform locking members) that selectively engage the first projections 625 or the second projections 630 to position the first platform 515 and/or the second platform 520 in either the horizontal orientation or the vertical orientation. In particular, each platform supporting member 640 includes a brace portion 645 pivotably coupled to the body 530 and an engagement portion 650 coupled to an end of the brace portion 645. Each brace portion 645 is pivotably coupled to the body 530 at a location between the corresponding pivot axis 525 and the end portion (e.g., the notches 580) of the corresponding first platform 515 or second platform 520. Each illustrated engagement portion 650 extends in a direction parallel to the corresponding pivot axis 525 (e.g., laterally from the corresponding brace portion 645). In addition, each engagement portion 650 is selectively received within the recess 635 of the first projection 625 or the second projection 630. In other embodiments, the platform supporting members 640 of the first platform 515 can be coupled together by including a single engagement portion 650 extending between the two brace portions 645. Likewise, the platform supporting members 640 of the second platform 520 can be coupled together by including a single engagement portion 650 extending between the two brace portions 645.

The first platform 515 and the second platform 520 are positioned in the vertical orientations when the platform supporting members 640 engage the second projections 630 of the first base member 415 and the second base member 420. As such, the first platform 515 and the second platform 520 are inhibited from moving into the horizontal orientations. As discussed above, this configuration of the support mount 400 can clamp the attachment member 615 between the notches 580 or clamp the firearm 20 between the first platform 515 and the second platform 520 using the adjustment knob 500. When the attachment member 615 or the firearm 20 is clamped between the first platform 515 and the second platform 520, the illustrated platform supporting members 640 are operable to counteract the moment loads about the pivot axes 525 to maintain the first platform 515 and the second platform 520 in the vertical orientations.

The first platform 515 and the second platform 520 are positioned in the horizontal orientations when the platform supporting members 640 engage the first projections 625 of the first base member 415 and the second base member 420. Movement of the first platform 515 from the vertical orientation to the horizontal orientation is discussed below, but is equally applicable to the movement of the second platform 520 from the vertical orientation to the horizontal orientation. In particular, by slightly rotating the first platform 515 about its pivot axis 525 toward the second platform 520, the engagement portion 650 of the platform supporting member 640 disengages the second projection 630 to provide enough clearance for the platform supporting member 640 to rotate upwardly relative to the body 530 of the first platform 515. With the platform supporting members 640 rotated upwardly, the first platform 515 can pivot about its pivot axis 525 away from the second platform 520. Upon movement of the first platform 515 into the horizontal orientation, the platform supporting members 640 can be moved relative to the body 530 of the first platform 515 for the engagement portions 650 to be received within the recesses 635 of the first projections 625. As a result, the first platform 515 is supported in the horizontal orientation. The first platform 515 can be again moved into the vertical orientation by simply moving the first platform 515 back toward the vertical orientation, which will move the engagement portions 650 out of engagement with the first projections 625. The platform supporting members 640 are moved relative to the first platform 515 to reengage the second projections 630 to position the first platform 515 in the vertical orientation.

Although the disclosure has been described in detail with reference to certain preferred embodiments, variations and modifications exist within the scope and spirit of one or more independent aspects of the disclosure as described. Various features and advantages of the disclosure are set forth in the following claims.

What is claimed is:

1. A support mount configured to couple a firearm and an accessory to a support stand, the support mount comprising:

a base assembly including an attachment member configured to be selectively coupled to the support stand, a first base member coupled to the attachment member, a second base member coupled to the attachment member, and an adjustment subassembly coupled to the first base member and the second base member;

a first platform moveably coupled to the first base member between a vertical orientation and a horizontal orientation relative to the first base member, the first platform configured to support the accessory when the first platform is in the vertical orientation or the horizontal orientation; and a second platform moveably coupled to the second base member between a vertical orientation and a horizontal orientation relative to the second base member, the second platform configured to support the accessory when the second platform is in the vertical orientation or the horizontal orientation, wherein the adjustment subassembly is operable to move the first platform and the second platform relative to each other, and wherein the adjustment subassembly is configured to clamp the firearm to the support mount.

2. The support mount of claim 1, wherein the first platform includes a first side having a first dovetail slot, and wherein the first dovetail slot is configured to receive an attachment member that is coupled to the accessory to support the accessory on the first side of the first platform when the first platform is in the horizontal orientation.

3. The support mount of claim 2, wherein the first platform includes a second side opposite the first side, wherein the second side includes a second dovetail slot, and wherein the second dovetail slot is configured to receive the attachment member to support the accessory on the second side of the first platform when the first platform is in the vertical orientation.

4. The support mount of claim 1, wherein the adjustment subassembly is configured to clamp an attachment member that is coupled to the accessory between the first and second platforms to support the accessory on the support mount.

5. The support mount of claim 1, wherein the first platform includes a first locking member that selectively secures the first platform in the vertical orientation or the horizontal orientation, and wherein the second platform includes a second locking member that selectively secures the second platform in the vertical orientation or the horizontal orientation.

6. The support mount of claim 1, wherein the adjustment subassembly is configured to clamp the firearm to the support mount when at least one of the first and second platforms is in the horizontal orientation.

7. A support mount configured to couple a firearm to a support stand, the support mount comprising:

an attachment member configured to be selectively coupled to the support stand;

a first platform movably coupled relative to the attachment member in a first orientation relative to the attachment member;

a second platform movably coupled relative to the attachment member in a second orientation, the second orientation being oriented differently than the first orientation of the first platform; and an adjustment subassembly operable to move the first platform and the second platform relative to each other, the adjustment subassembly configured to clamp the firearm to the support mount, wherein the first orientation of the first platform is positionable orthogonal to the second orientation of the second platform.

8. The support mount of claim 7, wherein the adjustment subassembly is configured to clamp the firearm to the support mount when the second platform is in the horizontal orientation.

9. The support mount of claim 8, wherein the second platform includes a first side having a first dovetail slot, and wherein the first dovetail slot is configured to receive an attachment member that is coupled to an accessory to support the accessory on the first side of the second platform when the second platform is in the horizontal orientation.

10. The support mount of claim 9, wherein the second platform includes a second side opposite the first side, wherein the second side includes a second dovetail slot, and wherein the second dovetail slot is configured to receive the attachment member to support the accessory on the second side of the first platform when the second platform is in a vertical orientation.

11. The support mount of claim 7, wherein the first platform includes a first locking member that selectively secures the first platform in the first orientation, and wherein the second platform includes a second locking member that selectively secures the second platform in the second orientation.

12. The support mount of claim 7, wherein the adjustment subassembly is configured to clamp an attachment member that is coupled to an accessory between the first and second platforms to support the accessory on the support mount.

13. A support mount configured to couple an accessory to a support stand, the support mount comprising:

an attachment member configured to be selectively coupled to the support stand;

a first platform movably coupled relative to the attachment member in a first orientation relative to the attachment member;

a second platform movably coupled relative to the attachment member in a second orientation, the second orientation being oriented differently than the first orientation of the first platform, the second platform configured to support the accessory when the second platform is in the second orientation; and an adjustment subassembly operable to move the first platform and the second platform relative to each other, wherein the first orientation of the first platform is positionable orthogonal to the second orientation of the second platform.

14. The support mount of claim 13, wherein the first platform includes a first side having a first dovetail slot, and wherein the first dovetail slot is configured to receive an attachment member that is coupled to the accessory to support the accessory on the first side of the first platform when the first platform is in the vertical orientation.

15. The support mount of claim 14, wherein the first platform includes a second side opposite the first side, wherein the second side includes a second dovetail slot, and wherein the second dovetail slot is configured to receive the attachment member to support the accessory on the second side of the first platform when the first platform is in a horizontal orientation.

16. The support mount of claim 13, wherein the adjustment subassembly is configured to clamp an attachment member that is coupled to the accessory between the first and second platforms to support the accessory on the support mount.

17. The support mount of claim 13, wherein the first platform includes a first locking member that selectively secures the first platform in the first orientation, and wherein the second platform includes a second locking member that selectively secures the second platform in the second orientation.

18. The support mount of claim 13, wherein the adjustment subassembly is configured to clamp a firearm to the support mount.

* * * * *